US011428085B2

(12) United States Patent
Castrogiovanni et al.

(10) Patent No.: US 11,428,085 B2
(45) Date of Patent: Aug. 30, 2022

(54) SYSTEMS AND METHODS FOR ENHANCED HYDROCARBON RECOVERY

(71) Applicant: World Energy Systems Incorporated, Fort Worth, TX (US)

(72) Inventors: Anthony Gus Castrogiovanni, Manorville, NY (US); George Vassilellis, Spring, TX (US); Marvin J. Schneider, League City, TX (US); Laura Capper, Houston, TX (US)

(73) Assignee: World Energy Systems Incorporated, Fort Worth, TX (US)

( * ) Notice: Subject to any disclaimer, the term of this patent is extended or adjusted under 35 U.S.C. 154(b) by 57 days.

(21) Appl. No.: 16/832,441

(22) Filed: Mar. 27, 2020

(65) Prior Publication Data

US 2020/0308944 A1 Oct. 1, 2020

Related U.S. Application Data

(60) Provisional application No. 62/825,285, filed on Mar. 28, 2019.

(51) Int. Cl.

| | |
|---|---|
| ***E21B 43/24*** | (2006.01) |
| ***E21B 43/16*** | (2006.01) |
| ***E21B 43/243*** | (2006.01) |
| ***F28F 13/00*** | (2006.01) |
| ***F24H 1/52*** | (2022.01) |
| ***F24H 9/14*** | (2006.01) |
| *E21B 43/26* | (2006.01) |
| *E21B 36/00* | (2006.01) |

(52) U.S. Cl.

CPC ..... *E21B 43/24* (2013.01); *E21B 43/164* (2013.01); *E21B 43/243* (2013.01); *E21B 43/2405* (2013.01); *E21B 36/003* (2013.01); *E21B 43/26* (2013.01)

(58) Field of Classification Search

None

See application file for complete search history.

(56) References Cited

U.S. PATENT DOCUMENTS 10,465,562 B2 * 11/2019 Zhang ..... F22B 33/00

* cited by examiner

*Primary Examiner* — Charles R Nold

(74) *Attorney, Agent, or Firm* — Patterson & Sheridan, LLP

(57) ABSTRACT

A system and method for enhanced hydrocarbon recovery utilizing steam. The system may include a high pressure water pump supplying pressurized water to a heat exchanger within a combustion heater to form supercritical steam that is provided to a reservoir. The combustion heater may be a surface mounted heater or a downhole steam generator.

20 Claims, 13 Drawing Sheets

SYSTEMS AND METHODS FOR ENHANCED HYDROCARBON RECOVERY

CROSS REFERENCE TO RELATED APPLICATION

This application claims benefit of U.S. Provisional Application No. 62/825,285, filed Mar. 28, 2019, the contents of which are herein incorporated by reference in their entirety.

BACKGROUND OF THE INVENTION

Field of the Invention

Embodiments of the invention relate to a system and method for enhanced hydrocarbon stimulation and hydrocarbon recovery utilizing advanced surface or downhole generated steam with characteristics suitable for injection into deeper, as well as conventional, reservoir depths. More specifically, to enhanced hydrocarbon recovery using either surface generated supercritical steam or downhole generated steam.

Description of the Related Art

Steam generated at the surface is currently the most common technology for in-situ thermal recovery of heavy oil reservoirs. However current technologies have significant limitations due to heat and/or steam quality loss that make them not economically attractive for the 2 trillion barrels of heavy oil located in deep reservoirs (e.g., greater than about 2,500 feet deep). These deep reservoirs require in-situ thermal stimulation to reduce the viscosity of the heavy oil for enhancing oil recovery.

Conventional surface generated steam typically undergoes a phase change from steam to water when injected in deep reservoirs due to thermal losses downhole, which affects the efficacy of the in-situ thermal stimulation. New technology is required to unlock these deep heavy oil reservoirs and allow steam to be used where it has previously not been economical.

There is a need for systems and methods to deliver steam to a hydrocarbon-bearing reservoir for enhanced hydrocarbon recovery.

SUMMARY

A system and method for enhanced hydrocarbon recovery utilizing steam is disclosed. In one embodiment, the system may include a high pressure water pump supplying pressurized water to a heat exchanger within a combustion heater to form supercritical steam that is provided to a reservoir.

In another embodiment, a method for producing hydrocarbons from a reservoir includes positioning a surface mounted combustion heater adjacent to a first well, supplying a fuel and an oxidant to the combustion heater, supplying pressurized water to a heat exchanger within the combustion heater, heating the pressurized water to form a supercritical steam, flowing the supercritical steam through a first conduit into the reservoir, and recovering hydrocarbons from the reservoir.

In another embodiment, a method for producing hydrocarbons from a reservoir includes supplying a fuel and an oxidant to a combustion heater, supplying pressurized water to a heat exchanger within the combustion heater, heating the pressurized water to form steam, flowing the steam through a first conduit into the reservoir, and recovering hydrocarbons from the reservoir.

BRIEF DESCRIPTION OF THE DRAWINGS

So that the manner in which the above recited features can be understood in detail, a more particular description of the embodiments, briefly summarized above, may be had by reference to embodiments, some of which are illustrated in the appended drawings. It is to be noted, however, that the appended drawings illustrate only typical embodiments and are therefore not to be considered limiting of its scope, for the embodiments may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation

DETAILED DESCRIPTION

Figure 1:
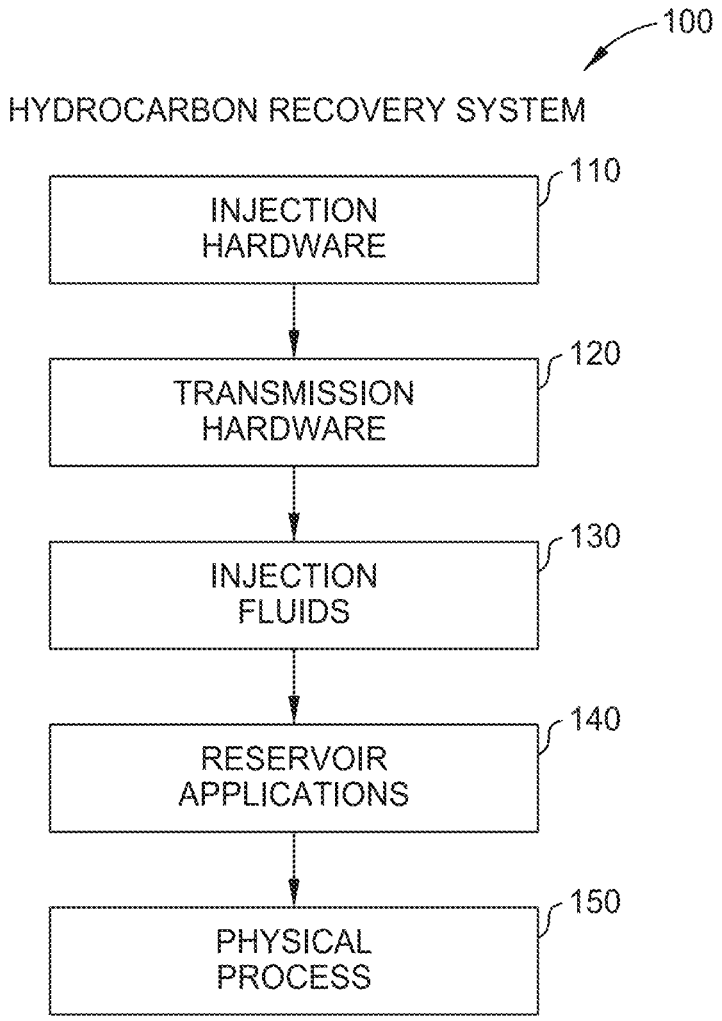
FIG. 1 is a diagram of an enhanced oil recovery system according to embodiments disclosed herein.

The various embodiments described herein relate to a system and method for enhanced hydrocarbon recovery utilizing advanced surface steam or downhole generated steam. While ordinary, high quality surface generated steam is currently the most common technology for in-situ thermal stimulation of a heavy oil reservoir, current technologies have significant limitations due to heat loss that make them not economically attractive for the 2 trillion barrels of heavy oil located in deep reservoirs. The supercritical steam generator technology option proposed herein is particularly suitable for recovering heavy oil from a number of known heavy oil reservoirs around the world that have experienced low recovery efficiencies through primary and secondary production methods, such as water flooding. The supercritical surface steam technology as disclosed herein is as at least as effective as, or more effective than, conventional downhole steam generation. Use of these embodiments is also equally suitable for enhanced oil recovery (EOR) from light tight oil (LTO), and especially light tight shale oil (LTSO), reservoirs.

Light oil reservoirs, typically at depths deeper than about 3,000 feet, constitute the majority of the current light oil reserves, which amounts to at least 1 trillion barrels. These reserves represent projected recovery efficiencies lower than 30% of the oil in place due to the inherently inefficient drive mechanisms with primary pressure depletion and pressure maintenance by water flooding. Thermal recovery mechanisms and displacement with carbon dioxide have the potential alone, or in combination to recover about twice as much. Although air injection and in situ combustion are thought to be beneficial methods to deliver these benefits, field implementation has shown that the initiation and maintenance of a reaction front is difficult to achieve, while the inevitable addition of nitrogen does not, in most cases, benefit, but rather complicates this process.

According to a USGS study of heavy oil and bitumen resources worldwide, over 96% of the heavy oil in the world occurs at depths greater than 2,500 feet (e.g., depths classified according to Klemme basin type characteristics). Worldwide, there remains a large inventory of relatively undeveloped fields, or fields that have only undergone primary production. In North America, the United States alone contains roughly 45 billion barrels of heavy oil that is currently too deep for effective thermal stimulation, and several formations such as the Grosmont in Canada are also at depths currently beyond reach, while Mexico is searching for new ways to implement EOR in their massive offshore heavy oil fields in the Bay of Campeche.

Internationally, Russia has a resource base of over 200 billion barrels of heavy oil, including one of the largest oil fields in the world, the Romashkinskoe, which is located at a depth of about 3,300 feet. China has over 100 billion barrels of heavy oil in several basins which are currently being piloted for steam flooding, even though they are dealing with low steam qualities. A United States Geological Survey (USGS) report also notes that the Middle East contains nearly one trillion barrels of heavy oil resources, the vast majority of which is undeveloped. Most of this resource is too deep to be reached by conventional technology.

Recovery factors of the heavy oil deposits are expected to be less than 5% without the implementation of advanced recovery techniques. Interest in steam flooding in the Middle East is growing, with steam injection pilot projects either underway or planned in Saudi Arabia, Kuwait, Syria, Iran, Turkey, and Oman. Heavy oil in Africa is reported by the USGS to be 80 billion barrels in Egypt, Angola, Congo and Madagascar, most of which is under-explored and undeveloped.

An advanced combustion and injection system (ACIS™) has been designed to enhance oil recovery using a downhole steam generation apparatus and/or a supercritical surface steam generation apparatus. ACIS™ can be used in a number of processes and applications for enhanced oil recovery as described herein.

FIG. 1 illustrates a hydrocarbon recovery system 100. There are many different embodiments of the hydrocarbon recover system 100 which FIG. 1 can represent and are explained in detail below.

The injection hardware block 110 represents the pieces of hardware that produce steam to be injected into the hydrocarbon reservoir. The injection hardware block 110 includes a downhole steam generator (DHSG) and/or a supercritical surface steam generator (SCSG).

If the injection hardware at block 110 comprises a DHSG, the DHSG is capable of controlling and injecting from the surface into a subsurface target some combination of fuel, oxidizer ($O_2$, oxygen rich air, or $H_2O_2$), and water, and optionally other non-reacting fluids and/or catalytic media, all of which flow to the DHSG. The DHSG is capable of managing combustion, mixing, and then vaporization of water. The DHSG tool effluent is then injected into a geological layer for the purpose of enhancing recovery from a petroleum or other mineral deposit.

One typical additional fluid that can be delivered downhole is carbon dioxide ($CO_2$). The low mobility of the injectants ($CO_2$ and steam) would penetrate a tight low permeability matrix, mobilizing oil from saturated micropores. Heat and thermal expansion would add additional drive that is beneficial in oil recovery. $CO_2$ can be either supplied to the DHSG using a separate conduit, produced by the DHSG and captured for use, or a combination of the two. Alternatively, nitrogen ($N_2$) or other inert gases may be co-injected.

By optional methods, the hydrocarbon recovery system 100 may be controlled so that a surplus quantity of the oxidizer is contained in the effluent stream leaving the DHSG, which then enters the oil rich formation where, by prior temperature and pressure management of the deposit, in situ oxidization of hydrocarbon or other fuels in the formation is enabled for the purpose of providing additional heat release and vaporization within the deposit, for the purpose of further enhancing recovery.

If and when the option for injection hardware at block 110 is a SCSG, the steam generating system is located above surface and is similarly capable of controlling at the surface some combination of fuel and oxidizer flow for combustion, plus water, and optionally other non-reacting fluids and/or catalytic media (without flue gas). The system manages combustion, mixing, and vaporization, and injects the effluent into a wellbore to be directed into a geological layer for the purpose of enhancing recovery from a petroleum bearing geologic formation.

One typical additional fluid that can be used is $CO_2$. This fluid can be either supplied to the system using a conduit, produced by the generator and captured and pressurized for use, or a combination of the two.

By optional methods, the hydrocarbon recovery system 100 may be controlled so that a surplus quantity of the oxidizer is contained in the effluent stream leaving the subsurface tool, which then enters the target formation where, by prior temperature and pressure management of the deposit, in situ oxidization of hydrocarbon or other fuels in the formation is enabled for the purpose of providing additional heat release and vaporization within the formation, for the purpose of further enhancing recovery.

Hardware Configuration

If a DHSG variant of ACIS™ according to one embodiment is utilized as the injection hardware at block 110, the transmission hardware block 120 may also include a custom wellhead, an umbilical, packer fluid, a packer and a tailpipe to deliver steam to a reservoir. The umbilical has a multistream configuration to deliver injectants at the DHSG apparatus. These injectants include some combination of fuel, oxidizer, and water, and optionally other non-reacting fluids and/or catalytic media.

If a SCSG variant of ACIS™ according to one embodiment is used as the injection hardware at block 110, the transmission hardware block 120 may also include insulated casing, VIT, and a downhole throttle may be used. Other combinations of injection hardware and transmission hardware are possible and may be beneficial in some circumstances.

The insulation or vacuum insulated double-coil tubing (VIT) is used to deliver supercritical steam downhole, either directly or through a throttle. Insulation may be necessary to keep the enthalpy of the steam high and to ensure that not too much energy is lost while traveling through the earth. Additional sources of insulation may be necessary.

The throttle can be used downhole to throttle down the steam to a pressure level reasonably higher than the reservoir pressure to ensure smooth injection into the formation. The throttle can be used on both or one of an injector well as well as a producer well if deemed necessary, or the throttle may not be used at all. If the ACIS™ system is used with a DHSG, then the umbilical is typically used as transmission hardware.

Injection Fluids

Injection fluids at block 130 when using the DHSG may include $O_2$, air, or $O_2$ enriched air, water optionally mixed with $O_2$ or $H_2O_2$ and parallel injectants such as $CO_2$ or other gases or catalysts. Fuel is also necessary to be injected into the DHSG in the ACIS™ system, however, fuel is not necessary to be injected downhole when using the SCSG. The $O_2$, air, or $O_2$ enriched air, is typically only used when the DHSG in the ACIS™ system is also in use. Exiting steam mixed with $O_2$ or $H_2O_2$ as well as the other parallel injectants can be utilized by either the DHSG system or the SCSG system. Water is primarily utilized for the purpose of creating the steam that is injected into the formations. Other parallel injectants such as $CO_2$ or catalysts are used to help improve recovery efficiency. Use of ACIS™ with residual oxidation (ROX) is utilized to increase temperature and speed up the breakdown of kerogen. The viscosity may also be able to be increased or decreased using a catalyst. Some examples of catalysts include nanocatalysts. The nanocatalyst may contain iron, nickel, molybdenum, tungsten, titanium, vanadium, chromium, manganese, cobalt, alloys thereof, oxides thereof, sulfides thereof, derivatives thereof, or combinations thereof. In one example, the nanocatalyst contains a cobalt compound and a molybdenum compound. In another example, the nanocatalyst contains a nickel compound and a molybdenum compound. In another example, the nanocatalyst contains tungsten oxide, tungsten sulfide, derivatives thereof, or combinations thereof. The catalytic material may contain the catalyst supported on nanoparticulate, such as carbon nanoparticles, carbon nanotubes, alumina, silica, molecular sieves, ceramic materials, derivatives thereof, or combinations thereof. The nanoparticulate or the nanocatalysts usually have a diameter of less than 1 μm, such as within a range from about 5 nm to about 500 nm.

Applications

Reservoir applications at block 140 include deep heavy oil, light oil, as well as unconventional oil resources, such as very tight oil or shale oil. While downhole steam generating systems variations of the ACIS™ system are primarily only able to be used for moderately deep heavy oil and light oil, an SCSG variation of ACIS™ is able to be used for oil reserves of even deeper heavy oil, light oil, and unconventional oil. This can give the SCSG system greater versatility at depth than the conventional DHSG system, particularly when either pressure fracturing and/or thermal fracturing is involved. Methods of operation using the DHSG or the SCSG system include continuous injection, cyclic injection, remediation and stimulation.

Physical Processes

The physical process at block 150 includes steps such as pressurization or re-pressurization of the formation, oil viscosity reduction, surface tension reduction of the hydrocarbons, miscible displacement, dilation of the formation, kerogen conversion, thermal fracturing, and hydraulic fracturing. Kerogen deposits inside the petroleum bearing formation can be converted to oil and gas that can be recovered. Dilation of the rock formation can enhance porosity and permeability of the petroleum bearing formation. The ACIS™ system is able to complete the processes of pressurization, oil viscosity reduction, surface tension reduction, miscible displacement, dilation, and kerogen conversion. The SCSG variant is able to complete all of the physical processes listed. The high pressure and temperature regime of SCS may effect stimulation of the petroleum bearing formation inducing thermal or mechanical fracturing which enhances the ability of liquid and vapor hydrocarbons to be produced.

Additional Embodiments

In one general embodiment, the hydrocarbon recovery system 100 utilizes injection hardware 110 such as the ACIS™ downhole steam generation system. This system uses a DHSG or some equivalent thereof that is lowered into a well having a substantially vertical section and a substantially horizontal section. The well may be drilled into a naturally pressurized or a partially pressure-depleted petroleum bearing formation. The well has casing for the DHSG. The casing near the bottom of the well, opposite the DHSG (i.e. downstream of the DHSG), may include high temperature metals and/or high temperature cement. For the subsequent production cycle, a production string can then be hung in the vertical section before the well becomes completely horizontal. The downhole steam generator is configured to inject one or more of fuel, water, steam, air, carbon dioxide, other inert gases, or catalysts into the depleted formation to re-pressurize the formation.

In the above embodiment an umbilical multi-stream configuration will likely be used for transmission hardware 120 to deliver the injection fluids 130 at the downhole steam generation apparatus. However, other fluid transmission hardware 120 could be used as needed depending on the depth, materials and insulation requirements. Steps should be taken to preserve as much of the heat and pressure as possible, while taking into consideration the operating and manufacturing costs of the transmission hardware 120.

The injection fluids 130 of the above embodiment can include fuel, $O_2$, air or $O_2$ enriched air, water, optionally mixed with $O_2$ or $H_2O_2$, and parallel injectants such as $CO_2$ or a catalyst. The parallel injectants and catalyst can be anything that enhances the hydrocarbon recovery process. Downhole systems such as this can be used for reservoir applications 140 such as the recovery of deep heavy oil or light oil, and are operated with either continuous fluid injection or cyclic injection. Injection into the petroleum bearing formation of the steam, carbon dioxide, inert gases, and/or surplus oxygen by a downhole steam generator can use flow paths following the induced hydraulic fractures emanating from primary production wells, and natural fractures. The physical process 150 includes pressurization of the formation, oil viscosity reduction, surface tension reduction, miscible displacement, dilation of the formation, and kerogen conversion.

In another general embodiment, the hydrocarbon recovery system 100 utilizes injection hardware 110 such as the ACIS™ downhole steam generation system. This system uses a DHSG or some equivalent thereof that is lowered into a well having a substantially vertical section drilled into a depleted oil formation. For the subsequent production cycle, a production string can then be hung in the vertical section. The downhole steam generator is configured to inject one or more of fuel, water, steam, air, carbon dioxide, other inert gases, or catalysts into the depleted formation to re-pressurize the formation.

In the above embodiment, an umbilical multi-stream configuration is used for transmission hardware 120 to deliver the injection fluids 130 at the downhole steam generation apparatus. However, other fluid transmission hardware 120 could be used as needed depending on the depth. Steps should be taken to preserve as much of the pressure as possible, while taking into consideration the operating and manufacturing costs of the transmission hardware 120.

A more specific embodiment of the recovery system 100 is also illustrated by FIG. 1. In this embodiment the injection hardware 110 is an ACIS™ system with a DHSG or some equivalent. The ACIS™ system is capable of controlling and injecting from the surface into a subsurface petroleum bearing formation some combination of fuel, oxidizer, and water, and optionally other non-reacting fluids and/or catalytic media, all of which flow to a subsurface tool capable of managing combustion, mixing and vaporization, and which tool effluent therefrom is then injected into a geological layer for the purpose of enhancing recovery from a petroleum or other mineral deposit. The DHSG has the advantage of heating the fluids directly before injection into the formation. This allows for greater control of the steam quality and temperature entering the formation.

This embodiment is utilized along with transmission hardware 120 inside conventional casing. Since the fluids are heated near the bottom-hole application site through the DHSG, it is not critical to insulate the fluids as if the fluids were heated above ground as in many previous steam injection systems. Therefore, expensive insulation is not necessary. There may also be casing at lengths up to a few hundred feet downstream of the DHSG. This downstream casing may need to be rated for high temperature and backed up by high temperature cement. Typically, injection fluids 130 of fuel and air, or $O_2$ enriched air are transmitted through the transmission hardware 120 for this application. However, it is possible that a use of other fluids such as water is able to be used for the creation of steam. Carbon dioxide and catalysts could also be used for the re-pressurization of the formation and enhanced recovery of hydrocarbons.

This system is typically used in reservoir applications 140 for recovery of heavy oil such as that found in the Kern Front in California and the Ugnu bitumen accumulation in Alaska, but could potentially be used for other applications as well, including light, tight shale oil. This embodiment is usually operated with continuous injection. Continuous injection of the fluids is typically done for several years, while offsetting wells in hydraulic communication continuously produce the mobilized hydrocarbons. In the absence of hydraulic communication between wells, this process can be applied in cyclic injection and production cycles from the same well. In both processes, the injection of carbon dioxide and water mobilizes and produces oil. Injection fluids 120 typically include fuel and air, $O_2$, or $O_2$ enriched air, and water. The physical process 140 for this system includes pressurization of the formation, oil viscosity reduction, surface tension reduction of the hydrocarbons, miscible displacement, and dilation of the formation. Conventional steam injection would be impaired by the depth (Kern Front) or the presence of permafrost (Ugnu). By using a DHSG, the challenge of keeping the injectants hot and keeping the steam quality high is overcome.

In another general embodiment, the hydrocarbon recovery system 100 utilizes injection hardware 110 such as a SCSG. In this embodiment the fluids are generally mixed and heated before entering the wellbore and are pressurized and heated to form a supercritical steam. Upon reaching a desired state, the fluids are injected into a conduit that brings the fluid down to the oil bearing formation. The pressure of the fluids may be changed or kept constant during the transmission.

This system also comprises high performance insulation and tubulars, or VIT as transmission hardware 120. VIT is advantageous because it is able to further reduce energy transfer from the fluid as the fluid is injected downhole.

Injection fluids 130 include water that is potentially mixed with $O_2$ or $H_2O_2$. This embodiment can be used for reservoir applications 140 in unconventional oil production. Unconventional oil production can include very tight oil and oil shales. This gives SCSG systems a very diverse range of applications. Different alterations of a SCSG system can be used for different applications. Physical processes 150 that are typically involved in this embodiment include dilation of the formation, kerogen conversion, thermal fracturing, and hydraulic fracturing.

Petroleum bearing formations which are characterized as tight oil resources often have been exploited by extensive hydraulic fracturing and horizontal drilling. This process is not as economic as it could be due to poor oil recovery of less than 10% of the oil in place. The hydraulic fracturing process in horizontal wells has evolved since its introduction in 2005 in the Barnett shale to accommodate not just shale gas, but liquid rich, or even oil bearing formations. In that evolution it was discovered that uniform and "complex" fracturing along long laterals achieves the best results. Having reached a large inventory of tight oil wells during the last 10 years, there is ample room to apply enhanced oil recovery to existing wells which have reached a low production plateau and are projected to stay in these low production levels for several decades, incurring operating costs and still holding considerable unrecovered reserves. Thus far, cyclic natural gas injection in volatile oil resources has been tried with some success, while $CO_2$ injection has been applied on a pilot basis. The former becomes commercially complicated as large quantities of natural gas have to be diverted to virtual underground storage during the injection cycles, while their sudden high rate recovery during the start of the production cycle is subject to transmission and processing constraints, imposing significant reduction of the oil production potential. The latest approaches require large quantities of $CO_2$ which are not generally available. A lot of the tight oil formations include solid organic material which can generate additional oil at high temperatures. The application of high-pressure downhole steam generation provides a solution for enhanced oil recovery in mature unconventional wells. In this application the reservoir conditions at a pressure consistent with a partially depleted state allow for the placement of an effluent slug, which is followed by a short soak period and return to production. As an alternative, where several wells exist and there is hydraulic communication between them, a drive scheme using dedicated injection and production wells may be utilized.

An embodiment of the process illustrated by FIG. 1 shows the possible implementation of downhole steam generation in tight oil bearing formations. This embodiment has reservoir applications 140 for the recovery of low pressure light oil, such as that found in formations like the Bakken in the Montana/Canada side or the Eagle Ford at shallow and/or depletion depths and pressures of less than 3000 psia. The injection hardware 110 necessary for this embodiment 100 would include an ACIS™ system with a DHSG or some equivalent. Banded tubulars of an umbilical would be used as the transmission hardware 120. A systems designed package comprising a custom wellhead, an umbilical, packer fluid, the DHSG, a packer and a tailpipe will be required. Since heating of the injectants occurs downhole, heat loss through while traveling down the wellbore is not as necessary to protect against.

The injection fluids 130 may include fuel and air (or $O_2$ enriched air), as well as $CO_2$ and water. These fluids would be injected directly into the formation or into the DHSG. If sent through the DHSG the fuel and air can react in a combustion process. Once this process is completed, injectants are either injected into the formation or recycled. It is also possible to use $CO_2$ that is created by the combustion process as injected $CO_2$. It is also possible for enough $CO_2$ to be produced from the combustion process such that external $CO_2$ is not necessary to inject. Continuous injection of the injectants is recommended, but not absolutely necessary, as this process can be applied by cyclic injection and production from the same well. The level of hydraulic communication between adjacent wells can determine that. The principal physical processes 150 provided by this embodiment are pressurization of the formation, oil viscosity reduction, surface tension reduction, miscible displacement, dilation of the formation, and kerogen conversion.

The application of supercritical steam, which has not yet been tried in the field, would potentially overcome enhanced oil recovery challenges in deep heavy oil deposits, common light oil reservoirs and tight oil formations, (including shale oil formations). Supercritical steam can be generally defined as steam that is above the saturation dome in a pressure versus enthalpy graph. Supercritical steam is beneficial because a distinct liquid and gas phase does not exist. Small changes in pressure or temperature can result in significant density, viscosity and diffusivity changes. Water above 217.75 atm/3200.1 psi and 647.096 Kelvin/373.946 degrees Celsius is said to be supercritical.

Another embodiment of FIG. 1 can be used to describe the main applicability of supercritical steam. Injection hardware 110 such as a SCSG along with transmission hardware 120 such as VIT, or any type of VIT alternative, can be used. Injection fluids 130 include water (or water mixed with $O_2$ or $H_2O_2$) and can be used for the recovery of unconventional oil 130, such as high pressure light tight shale oil. Other fluids such as air (or enriched air) and $CO_2$ could also be found to have uses in this process. The SCSG is capable of superheating and pressurizing the fluid to a supercritical state. This is done above ground before entering the wellbore. The pressure and temperature of the steam can be controlled as needed so that the steam reaches the bottom of the wellbore at a desired state. The VIT or a similar equivalent is used as insulation to keep the fluid pressures and temperatures high and reduce the amount of energy lost to the wellbore.

This embodiment is effective for reservoir applications 140 such as deep high pressure tight oil formations, such as the Wolfcamp or deep Bakken Formations. This can be done either by continuous or periodic injection (i.e., cyclic), or as a localized treatment of the formation. The thermal effects of slowly heating the formation with steam would result in a physical process 150 of dilation of rock and fluids which is a very strong oil drive. In addition to that, extra high temperatures will trigger a breakdown of long kerogen molecules into crude oil components, while extra high pressures would trigger or expand hydraulic fracturing.

The energy of the supercritical steam once released into the formation has the ability to stimulate it in a concentrated and uniform fashion. The introduction of a small amount of oxidant together with the supercritical steam will add an in-situ combustion benefit in a controlled manner and without adding unwanted amount of $N_2$.

Another embodiment is very similar to the embodiment described above, except the reservoir application 140 is for unconventional oil such as very tight oil or shale oil (e.g., Eagle Ford Shale Formation). This embodiment includes a high impact localized application of supercritical steam to a portion of a horizontal wellbore. This can be used in a new, or an existing, oil producing well that needs re-stimulation. The localized treatments would produce re-stimulation through thermal and hydraulic fractures. The induced stresses together with the thermal shock affected by the injection process would re-stimulate the formation enhancing the producibility of already producing wells which have already gone through a primary production cycle.

The injection of high quality steam is an attractive method for the production of heavy oil or light tight shale oil. Steam is typically generated on the surface using once-through steam generators (OTSG) in a central plant location with an insulated network of piping used for distribution to individual wellheads. While thermal losses on the surface are partially manageable with modern insulation, downhole losses are considerably more difficult to deal with, particularly since heat losses become increasingly more pronounced with depth. Advanced approaches including the use of VIT have been employed to minimize the problem, however heat losses at tubing joints are considerable and VIT is reported to be very expensive and fragile. Other insulated conduits may be necessary.

In shallower formations where the reservoir pressure is close to, or lower than supercritical steam pressures, it would be necessary to reduce injection pressures and volumes as this may trigger excessive hydraulic fracturing to the point that may exceed by far the reach of the producing wells and thus becoming counter-productive. The process diagram shown in FIG. 1 describes another embodiment of the invention herein for reservoir applications 140 related to relatively low-pressure tight oil formations. This embodiment would use injection hardware 110 such as a SCSG to generate supercritical steam at the surface. The transmission hardware 120 would include a VIT or a similar insulation tubing and would be used to transfer the fluid down through the wellbore. The supercritical steam generated would be throttled back close to reservoir pressure levels to avoid massive hydraulic fracturing, which may not be advantageous or necessary. During the throttling process, the high enthalpy supercritical steam would transition into high enthalpy high quality steam which would heat the formation, triggering heat related oil recovery processes. Injectants 120 would include water mixed with $O_2$ or $H_2O_2$ and parallel injectants including $CO_2$ or a catalyst. Cyclic injection would be used. The principal processes include pressurization of the formation, surface tension reduction, miscible displacement, and dilation of the formation. This embodiment may be utilized to advantage in the Niobrara or San Andres shale formations, as examples.

Figure 2:
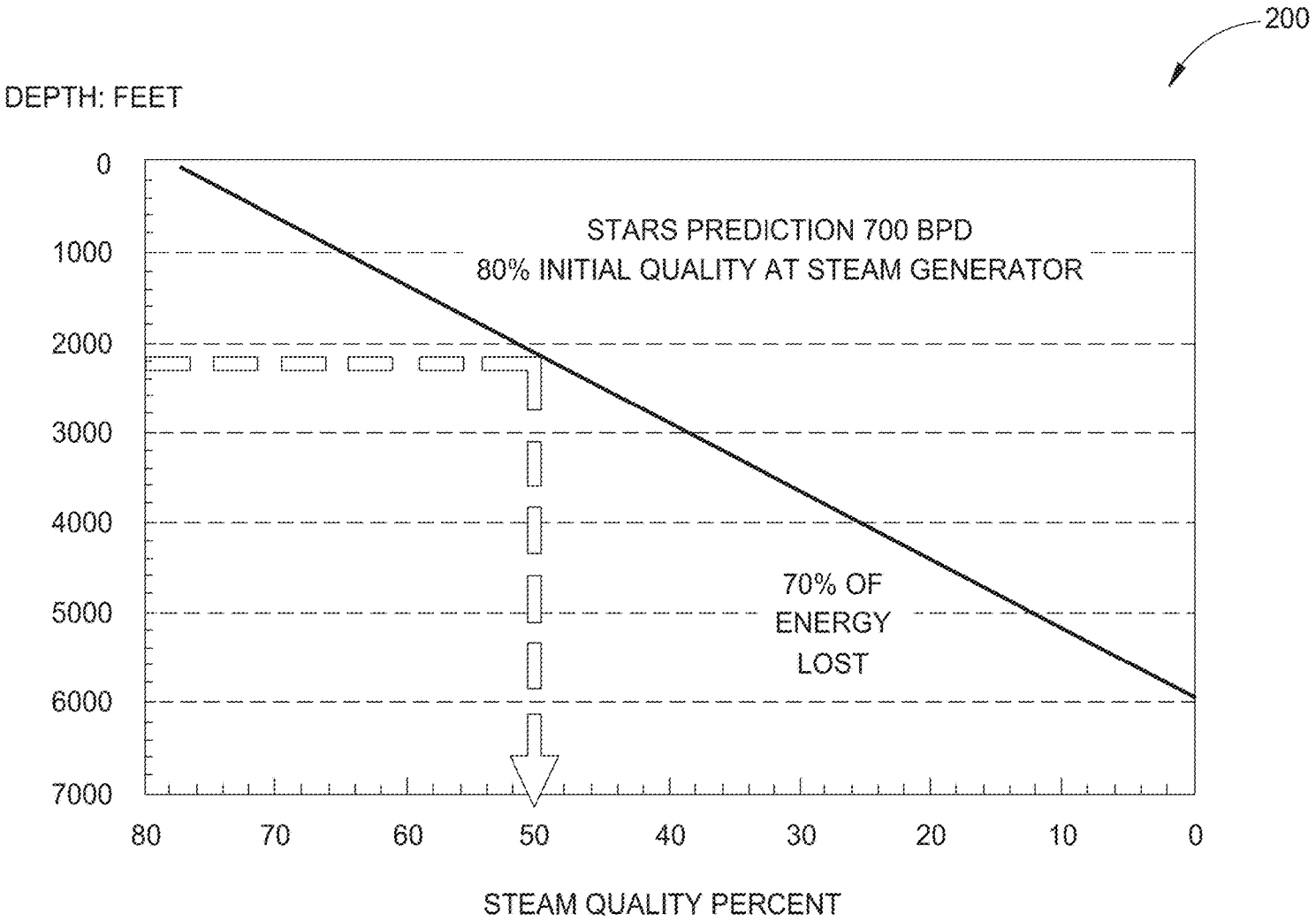
FIG. 2 is a graph representing a computational fluid dynamics (STARS) prediction of steam quality vs. depth for a typical surface steam generator using conventional insulation.

FIG. 2 shows a graph 200 representing a computational model (STARS) prediction of steam quality vs. depth for a typical surface steam generator using insulated casing. These results are consistent with the general industry assumption of 2,500 feet to 3,000 feet as a practical limit to surface generated steam use. Additionally, thermal recovery of heavy oil that resides beneath permafrost such as Ugnu in Alaska requires a method of steam injection that does not adversely impact the integrity of the frozen permafrost layer.

Figure 3:
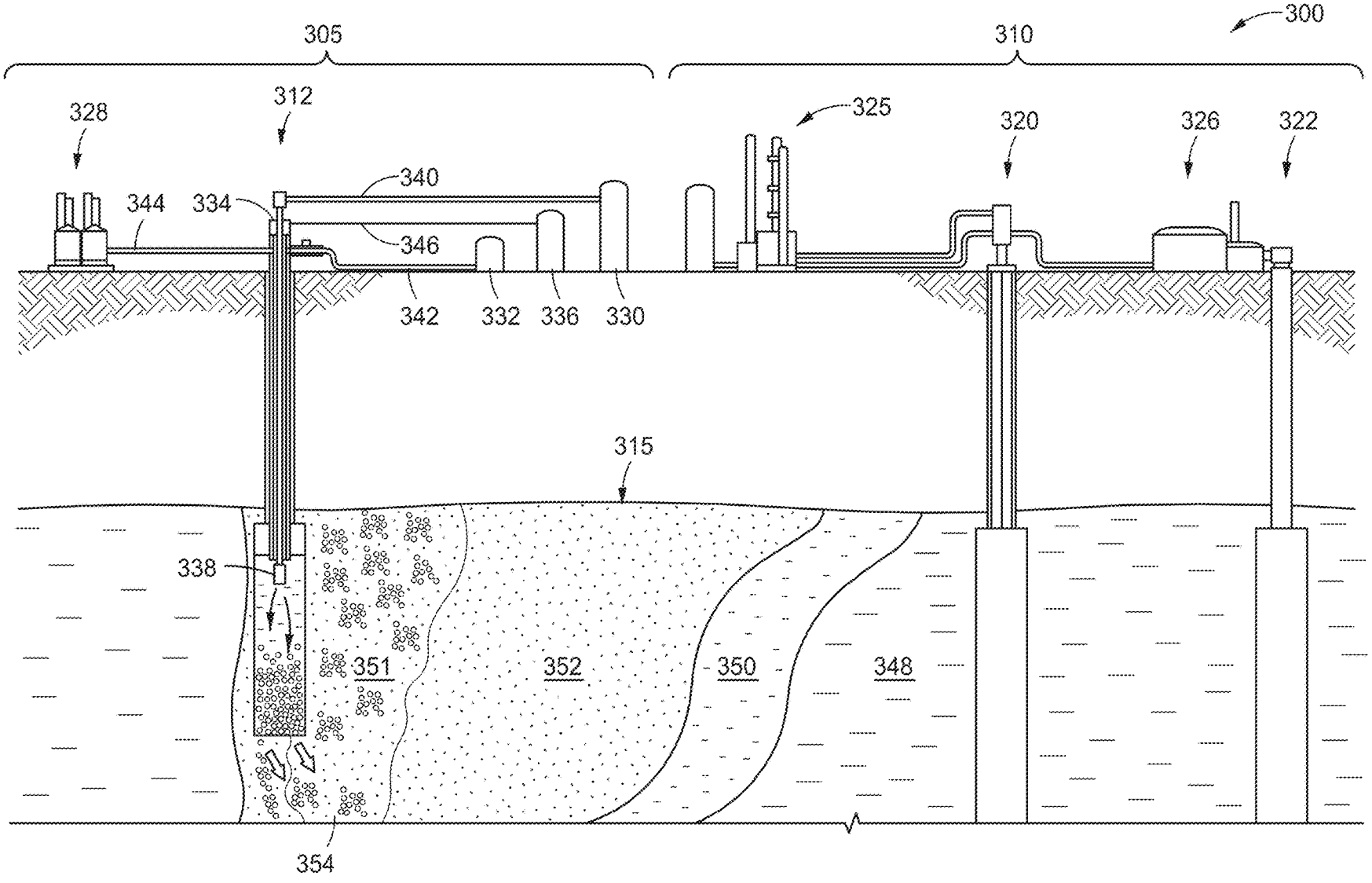
FIG. 3 is a schematic view of a downhole steam generator system.

FIG. 3 is a schematic elevation view of one embodiment of an enhanced oil recovery (EOR) system 300, which is utilized in embodiments using the ACIS system with a DHSG. The EOR system 300 includes a first surface facility 305 and a second surface facility 310. The first surface facility 305 includes an injector well 312 that is in communication with a reservoir 315.

The reservoir 315 may be a shale oil formation, or any other formation, that has recently been in production but production has declined such that the reservoir 315 is considered pressure depleted. However, the reservoir 315 may still contain light oil and gas that may be produced using embodiments described herein.

The second surface facility 310 comprises a first producer well 320 and a second producer well 322 that is in fluid communication with the reservoir 315. The second surface facility 310 also includes associated production support systems, such as a treatment plant 325 and a storage facility 326. The first surface facility 305 may include a compressed gas source 328, a fuel source 330 and a steam precursor source 332 that are in selective fluid communication with a wellhead 334. Additional wells (not shown), such as "infill" wells, may be drilled as needed to decrease average well spacing and/or increase the ultimate recovery from the reservoir 315. The additional wells may also be utilized to control pressure and/or temperature within the reservoir 315.

In use, the EOR system 300 may operate after the injector well 312 is drilled and a downhole burner or DHSG 338 (downhole steam generator) is positioned in the wellbore of the injector well 312 according to a completion process as is known in the art. Fuel is provided by the fuel source 330 to the downhole steam generator 338 by a conduit 340. Water is provided by the steam precursor source 332 to the DHSG 338 by a conduit 342. An oxidant, such as air, enriched air (having about 35% oxygen), 95 percent pure oxygen, oxygen plus other inert diluents may be provided from the compressed gas source 328 to the wellhead 334 by a conduit 344. The compressed gas source 328 may comprise an oxygen plant (e.g., one or more liquid $O_2$ tanks and a gasification apparatus) and one or more compressors.

The fuel source 330 and/or the steam precursor source 332 may be stand-alone storage tanks that are replenished on-demand during the EOR process. Alternatively, the fuel and/or the steam precursor may be continuously supplied via a pipeline. Gases or liquids that may be used as fuel include hydrogen, natural gas, syngas, or other suitable fuel. The viscosity-reducing source 336 may deliver injectants, such as viscosity reducing gases (e.g., $N_2$, $CO_2$, $O_2$, $H_2$), particles (e.g., nanoparticles, microbes) as well as other liquids or gases (e.g., corrosion inhibiting fluids) to the downhole steam generator 338 through the wellhead 334 through a conduit 346. The viscosity-reducing source 336 may be an important pipeline and/or a standalone storage tank(s) that are replenished on-demand during the EOR process.

FIG. 3 also shows one embodiment of an EOR process. Starting from the side of the reservoir 315 adjacent the producer wells 320 and 322, zone 348 includes a volume of mobilized, low viscosity hydrocarbons. The low viscosity hydrocarbons are a result of viscosity-reducing gases in zone 350 and a high-quality steam front within zone 352 that converts kerogen deposits 351 into oil and gas that may be recovered. Zone 350 comprises a volume of gas, such as $N_2$, $O_2$, $H_2$, and/or $CO_2$, in one embodiment, which mixes with the oil that is heated by steam from zone 352. The steam front within zone 352 consists of high quality steam (e.g., up to 80% quality or greater) and includes temperatures of about 100 degrees Celsius (C) to about 300 degrees C., or greater. Adjacent the steam front is zone 354, which comprises a residual oil oxidation front. Zone 354 comprises heated kerogen and excess oxygen.

Figure 4:
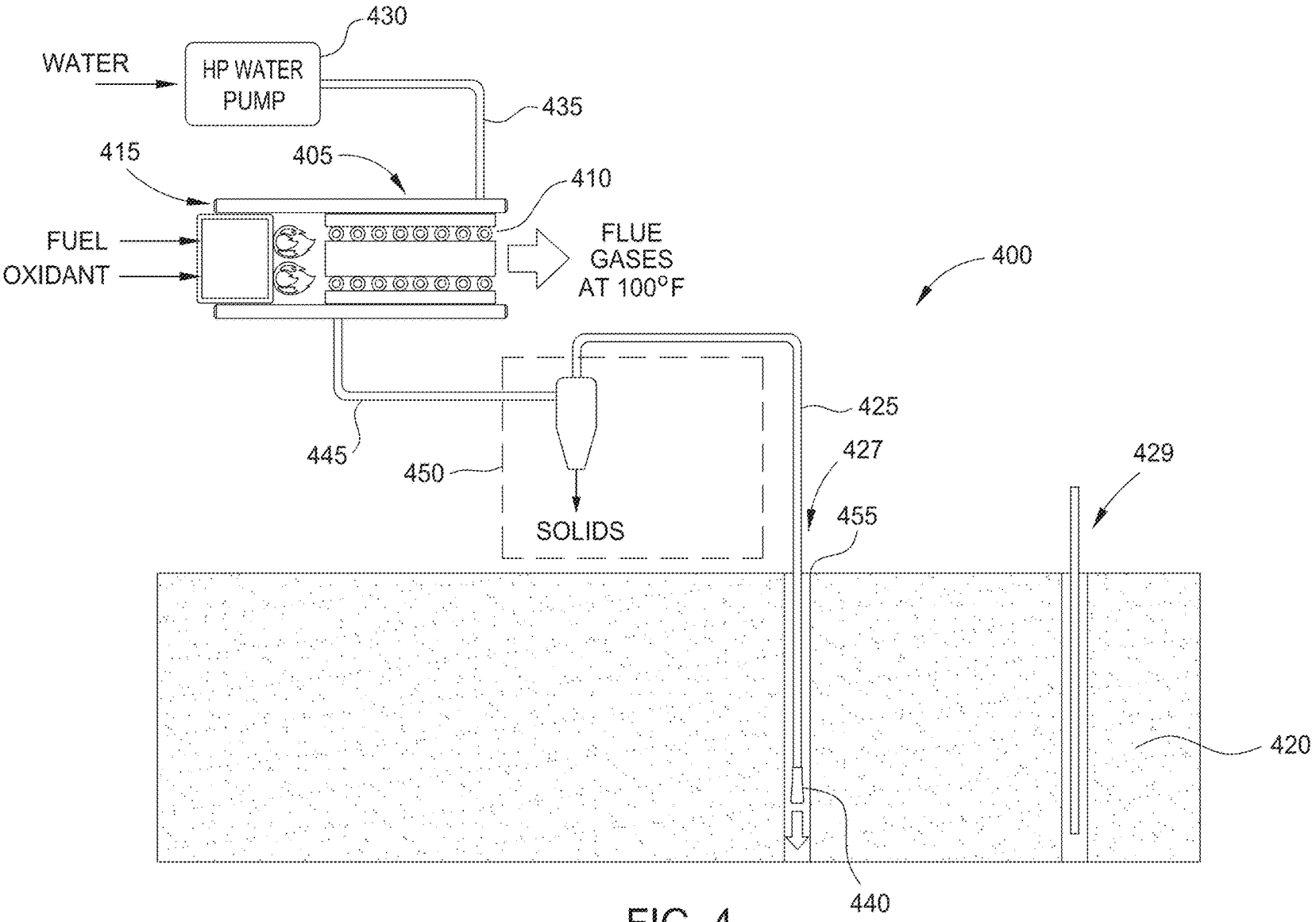
FIG. 4 is a schematic view of a steam generator system according to one embodiment.

FIG. 4 is a schematic view of a surface steam generator system 400 according to one embodiment. The steam generator system 400 includes a low pressure, fuel-flexible combustion heater 405 integrated with a high pressure heat exchanger 410 to define a supercritical steam generator 415. The supercritical steam generator 415 produces supercritical steam that is injected into a reservoir 420 via a downhole conduit 425 such as VIT that extends downhole through an injector well 427 to stimulate hydrocarbons in an enhanced oil recovery process.

The steam generator system 400 is in fluid communication with the reservoir 420 via the injector well 427. Hydrocarbons recovered from the reservoir 420 may be produced up to the surface via the injector well 427 using a cyclic process. Alternatively, hydrocarbons recovered from the reservoir 420 may be produced up to the surface in a continuous process via one or more producer wells 429 that is offset from the injector well 427.

Water is provided to the heat exchanger 410 from a high pressure water pump 430 via a first conduit 435 where the water is heated by the combustion heater 405. The reliable pumping of liquid phase water to pressures in the range of 6,000 psia (41 MPa), or higher, may not require advanced technology, though consideration for water quality and system wear is critical. As an example, for the purpose of proof-of-concept testing at the single wellbore level (or below), a standard commercial power washer can provide the pressure and flow rate required. More advanced and capable pumps currently used in support of water jet machining operations are also good candidates.

The combustion heater 405 required to heat the high pressure water may be a derivative of one the many heaters designed, built and tested by ACENT Laboratories of Bohemia, N.Y. Several combustion heater designs may be readily adapted including a highly compact design recently developed for downhole applications such as a downhole steam generator as described in U.S. Pat. No. 8,613,316, the contents of which are herein incorporated by reference in its entirety. Since the current application is to provide heat to pressurized water in a heat exchanger (HEX) configuration, the combustor pressure is a variable that will primarily impact the size of the combustion heater 405. It is expected that a "low pressure" combustion heater 405 operating in the range of 500 psia (3.5 MPa) will be sufficient.

A high pressure water HEX will be designed to accommodate flow rates typical of that required for a single wellbore for a steam flood application (e.g. 1,500-2,500 b/d). A key part of this effort is selecting a high pressure water HEX that is formed from an appropriate high nickel alloy material such as HAYNES® 230®, HASTELLOY® C. or X, and those in the INCONEL® 600 and 800 series. Some future supercritical injection projects will require much higher flow rates, i.e. 10,000 to 15,000 b/d, or more.

This is expected to be within the realm of available industry technology utilizing larger tubulars.

The downhole conduit 425 may be readily available coiled tubing or joined string and standard insulation currently used in steam flood applications. Several of the aforementioned high nickel alloys are currently available as coiled tubing or joined string for the oil and gas industry. Vacuum insulated tubing may also be used if appropriate high-pressure systems are available or developed.

In one embodiment, supercritical steam is provided to a throttle 440 disposed in the reservoir 420 at the end of the downhole conduit 425 via a second conduit 445 that routes the supercritical steam from the supercritical steam generator 415 to an optional high pressure particle separator 450 to remove solids from the supercritical steam. The downhole conduit 425 passes through an insulated casing 455 disposed in the injector well 427 to minimize thermal losses in the reservoir 420. The insulated casing 455 may be a 7 inch casing with standard insulation (k=0.15 BTU/hr $ft^2$ F) according to one embodiment.

A packer (not shown) may be placed between the insulated casing 455 and the downhole conduit 425 either above or below the throttle 440. The proposed device is expected to be adaptable to a standard thermal packer with minor changes required to accommodate the increased temperature if it is decided to install the throttle below the packer. Throttling of the steam above the packer is an option that will allow the use of a commercial thermal packer such as those produced by Baker Hughes. The throttle 240 may include a simple orifice such as a de Laval nozzle to minimize vibration and noise. Consideration for a variable geometry throat will be included if the advantages are deemed to outweigh the added complexity and risk of a non-passive design. In some embodiments, the throttle 240 may be excluded or simply be a low pressure-drop orifice. The throttle 240 may also be installed on producer wells. This would keep the pressure inside of the reservoir greater, and would therefore also keep the steam supercritical for at least a portion of the journey through the reservoir.

In one embodiment, water is provided to the heat exchanger 410 in an amount of about 1,500 barrels per day pressurized to about 6,000 psia at a temperature of about 70 degrees Fahrenheit (F). If water with high levels of total dissolved solids is utilized, the high pressure particle separator 450 is utilized. Supercritical steam from the supercritical steam generator 415 in the second conduit 445 is heated to about 900 degrees F. and is at a pressure of about 5,750 psia, according to one embodiment.

After passing through the high pressure particle separator 450, the supercritical steam is provided to the downhole conduit 425, which has an outside diameter of about 3.25 inches and an inside diameter of about 2.25 inches, at a pressure of about 5,500 psia and a temperature of about 847 degrees F. Upstream of the throttle 440, the supercritical steam is at a pressure of about 3,100 psia and at a temperature of about 700 degrees F. The supercritical steam passes through the throttle 440 and into the reservoir 420 at a pressure of about 1,500 psia and a temperature of about 565 degrees F., according to one embodiment.

The steam generator system 400 is capable of producing supercritical steam reaching high pressures and temperatures with very high density as compared to other water or steam injection methods. For applications where the pressure in the reservoir is less than half of that in the injection line, passive throttling across a critical flow orifice at the bottom of the wellbore results in very high quality steam at reservoir pressure due to significantly lower wellbore heat loss from the small diameter tubing compatible with the flow rate and pressure drop required. Preliminary calculations indicate that a 50% quality steam threshold is reached at a depth of approximately 6,500 feet (1980 meters) using conventional insulation for common steam drive flow rates and wellbore dimensions. The heat transfer process in the surface steam generator occurs after the water has been pumped to approximately 6,000 psia (41 MPa) so that the cost of compression is minimized as it is liquid phase. Other typical uses will be somewhat higher pressure.

Figure 5:
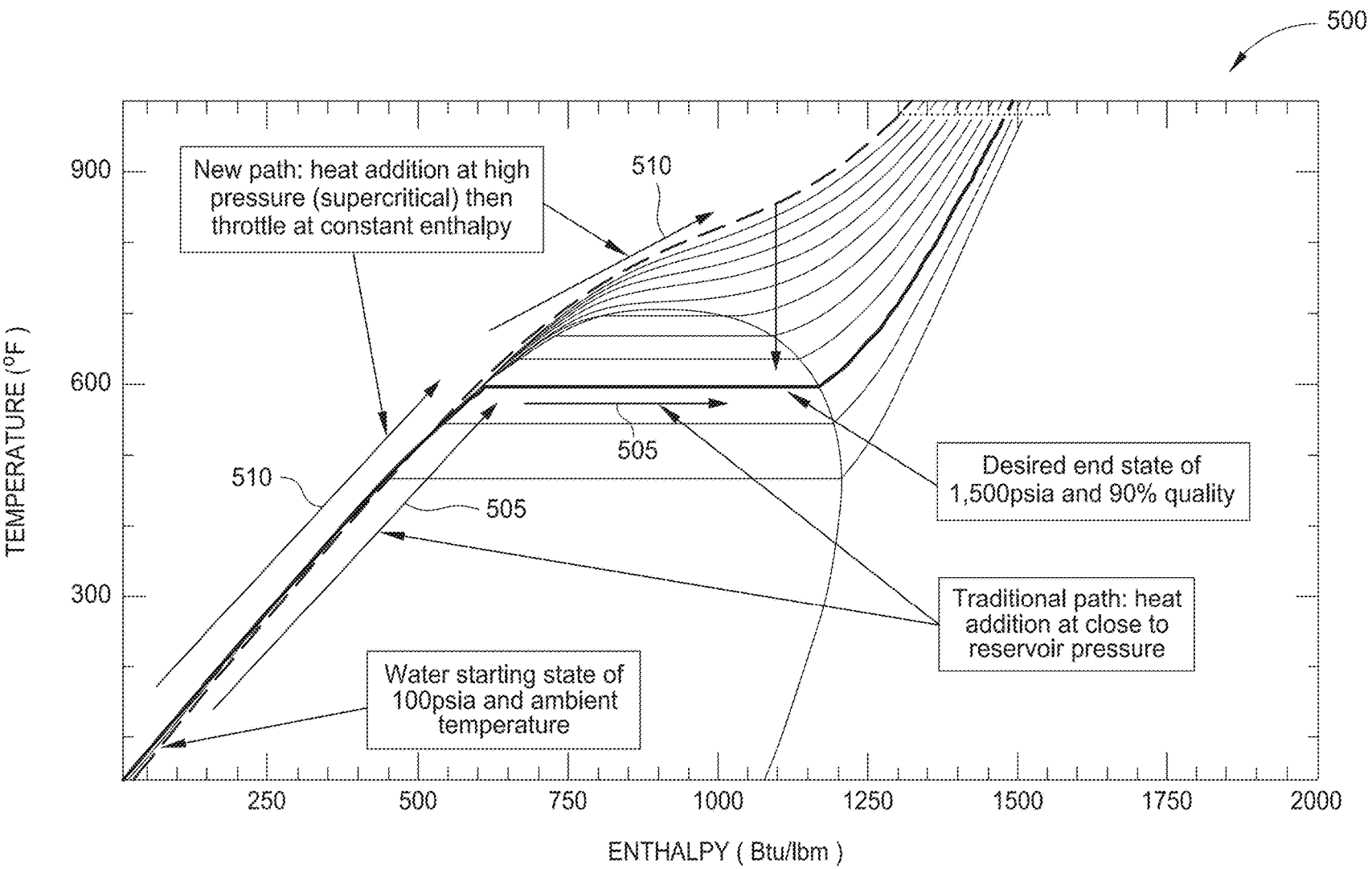
FIG. 5 is a temperature-enthalpy diagram.

The thermodynamics of the steam generator system 400 shown in FIG. 4 are best described using a temperature-enthalpy (T-h) diagram 500 as shown in FIG. 5. Pressure drop and heat loss in the wellbore is neglected in the diagram 500 for simplicity.

A traditional once-through steam generator (OTSG) is depicted by arrows 505 following the constant pressure line at 1,500 psia (10.3 MPa). Here the water is initially pressurized and then heated through a two-phase saturation region until the desired quality is achieved.

The new supercritical steam path provided by the steam generator system 400 of FIG. 4 is shown by arrows 510 initially following the 6,000 psia (41 MPa) isobar until the desired enthalpy is achieved. At the bottom of the wellbore, the throttle 440 having a simple orifice throttles the flow (enthalpy=constant for throttling process) to balance with the pressure of the reservoir 420. Both paths involve the essentially same enthalpy increase, but the key advantage of the high pressure supercritical path is seen when steam density is compared.

Table 1 below summarizes the density of water/steam for a variety of pressures at a constant enthalpy corresponding to 80% steam quality at 1,500 psia (10.3 MPa), which will be referred to as the "baseline." It can be seen that at 6,000 psia (41 MPa), supercritical steam has more than four times the density compared to the baseline as would be expected based on the pressure ratio. The cost of obtaining this additional water pressure is small compared to the benefits that accrue from the increased density since liquid phase pumping is highly efficient. This is evident from Table 2.

Table 2 below shows the enthalpies for water compression starting from 100 psia (0.69 MPa) and is summarized for constant entropy (ideal) conditions. Assuming a pump with 85% efficiency, the enthalpy required to pressurize to 6,000 psia (41 MPa) is (55.8-38.4)/0.85=20.4 BTU/lbm (47.5 kJ/kg) which is only 2% of the enthalpy required to get to the 80% steam quality condition required due to the relatively high latent heat of water.

TABLE 1

Comparison of steam densities at constant enthalpy.
h = 1058 BTU/lbm = 2461 kJ/kg

| Pressure psia (MPa) | Temperature ° F. (° C.) | Quality | Density $kg/m^3$ | Density/ Baseline Density |
|---|---|---|---|---|
| 1500 (10.3) | 596 (313) | 80% | 4.42 (71) | 1.0 |
| 2500 (17.2) | 668 (353) | 90% | 9.07 (145) | 2.1 |
| 3500 (24.1) | 731 (388) | Supercritical | 11.86 (190) | 2.7 |
| 4500 (31.0) | 783 (417) | Supercritical | 14.77 (237) | 3.3 |
| 6000 (41.3) | 840 (449) | Supercritical | 18.44 (295) | 4.2 |

TABLE 2

Comparison of water enthalpy at various pressures and constant entropy. 0.075 BTU/lbm F = 0.3138 kJ/kg K

| Pressure psia (MPa) | Temperature ° F. (° C.) | Enthalpy BTU/lbm (kJ/kg) |
|---|---|---|
| 100 (0.7) | 70 (21) | 38.4 (89.2) |
| 1500 (10.3) | 668 (353) | 42.5 (98.9) |
| 4500 (31.0) | 731 (388) | 51.4 (119.4) |
| 6000 (41.3) | 783 (417) | 55.8 (129.6) |

The increased density allows use of an insulated tubing string with an internal diameter that is approximately half that of the lower pressure baseline case. This results in four times less cross sectional area maintaining the same velocity if flow rate is held constant. Correspondingly, the surface area in contact with hot steam is half that of the baseline low pressure case, though the steam temperature is somewhat hotter: 840° F. (449° C.) versus 596° F. (313° C.).

Allowing for increased tubing thickness to accommodate the higher pressure and assuming the same wellbore internal diameter of 7 inches (18 cm) for the two cases, the new supercritical approach allows for approximately 1 inch (2.5 cm) additional radial insulation around the tubing. A calculation of the convective heat transfer across the tubing and insulation reveals a "net" of approximately 65% heat loss reduction between the high and low pressure cases when all factors including surface area and insulation are taken into account (flow rate and tube velocity held constant). This significant reduction in the all-important wellbore heat loss is illustrated schematically in the T-h diagram shown in FIG. 5.

Figure 6:
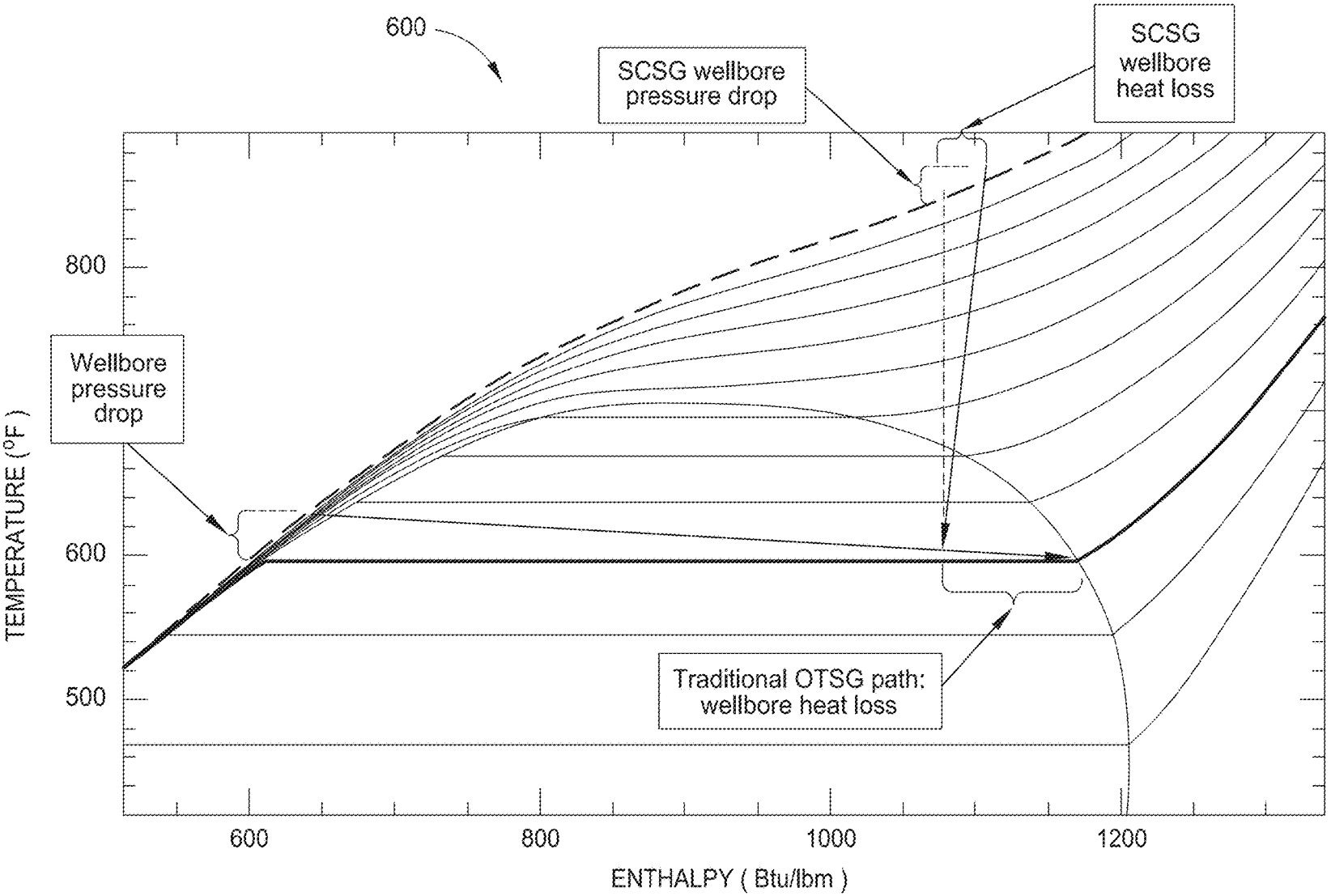
FIG. 6 is a temperature-enthalpy diagram comparing wellbore heat losses between the supercritical steam generator system as described herein and conventional approaches.

FIG. 6 is a diagram 600 comparing wellbore heat losses between the steam generator system 200 as described herein (e.g., "SCGS") and conventional (e.g., "traditional OTSG") approaches.

Preliminary results of steam quality versus depth predictions comparing a traditional OTSG producing 90% quality steam at the surface with the high pressure SCSG is shown in Table 3 with 90% steam quality at the surface. This analysis assumes the same mass flow and wellbore velocity and insulation type for both cases. As seen, the SCSG produces dramatically better results.

TABLE 3

Comparison of steam quality vs. depth for SCSG and OTSG.

| Depth [ft] | Depth ft [m] | SCSG Quality | OTSG Quality |
|---|---|---|---|
| 2000 | 610 | 78% | 59% |
| 2500 | 762 | 75% | 51% |
| 3000 | 914 | 72% | 44% |
| 3500 | 1067 | 69% | 36% |
| 4000 | 1219 | 66% | 29% |
| 4500 | 1372 | 64% | 21% |
| 5000 | 1524 | 61% | 14% |
| 5500 | 1676 | 58% | 7% |
| 6000 | 1829 | 55% | Liquid |
| 6500 | 1981 | 53% | Liquid |

Modern advancements in metallurgy from aerospace industry and recent applications of ultra-supercritical (USC) steam generation for stationary power plants now allow continuous flow of steam at relevant conditions using chrome and nickel-based super alloys. These USC systems operate temperatures in the range of 1202° F. (650° C.) which is significantly higher than proposed here. The increased cost of the completion attributable to the use of these materials is not significant considering the increased depths made possible by mitigating energy losses to the overburden. Additionally, the steam generator system 400 enables thermal recovery in reservoirs that are currently inaccessible, essentially converting a multitude of existing resources to reserves.

The technology of the steam generator system 400 as described herein may provide the basis for a new generation of thermal in-situ enhanced hydrocarbon recovery systems to unlock deep heavy oil resources as well as those in environmentally challenged locales such as offshore or under arctic or even permafrost environments. Given the current interest in enhanced hydrocarbon recovery and the vast global quantity of unconventional resources, there is significant justification for a generation of new technologies to open the door to large scale heavy oil developments that have previously not been exploitable. If heavy oil fields deeper than approximately 2,500 feet were able to leverage the benefits of thermal stimulation and the enhanced hydrocarbon recovery processes described herein, recovery factors could be expected to increase multifold over what has been demonstrated using conventional approaches.

It has been reported that there are 37 billion barrels of recoverable deep heavy oil in Alaska that are currently not commercially producible with other technologies due to high viscosity levels and concerns about melting the permafrost. By mitigating heat losses through the wellbore to the permafrost, as-yet untapped regions of these Alaskan resources could potentially be produced profitably and without threat to the environment. Although a DHSG will likely be preferred for typical permafrost and near offshore applications, an SCSG may still be needed to handle deeper applications. The basic SCSG design with premium insulation or VIT will handle those instances where the injector life is short enough that temperature buildup does not exceed allowable thresholds. For longer life, injector cooling will be needed. Cooling can be accomplished effectively by annular injection of a small side stream of feed water, or $CO_2$, that is co-injected with the supercritical steam stream. This cooling approach may result in a lower bottom hole temperature with a reduction in steam quality. However, the core temperature of the supercritical injection stream may be raised to compensate for the temperature loss due to injector cooling.

The steam generator system 400 as described herein holds significant promise to provide operators with a new approach to producing deep heavy oil with higher recovery factors and in less time than possible with conventional methods. From this perspective, the technology as described herein is potentially a uniquely enabling technology for the production of vast untapped resources. The beneficiary list is long, but includes oilfield operators, peripheral equipment and service providers, oil producers and the general public consumer of petroleum products. In another embodiment, a supercritical steam process using the steam generator system 400 delivers high pressure steam heat and $CO_2$ in a cyclic or continuous injection regime targeting unconventional reservoirs comprising tight shale oil at a depth of about 5,000 feet, or greater.

Figure 7:
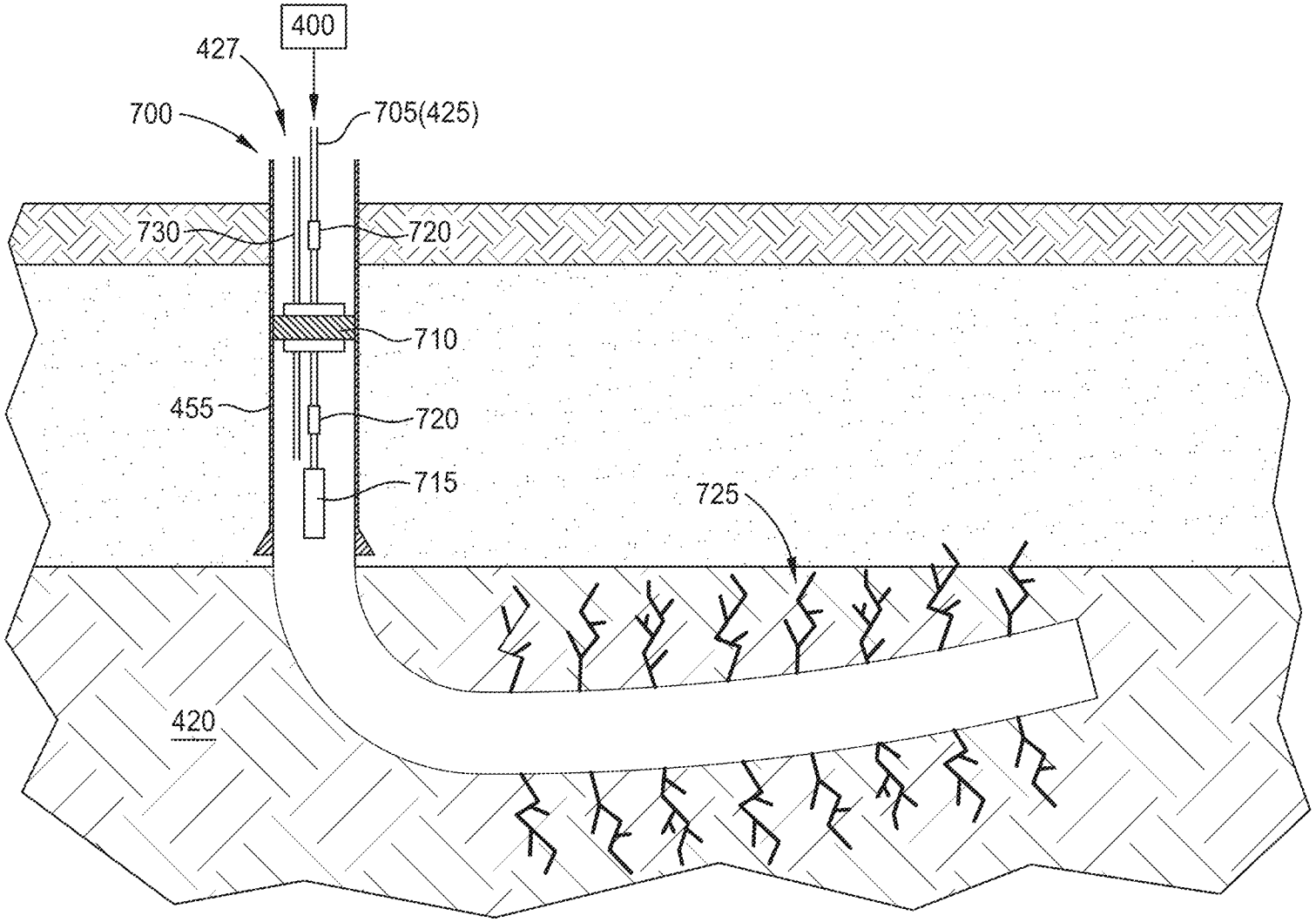
FIG. 7 is a diagram showing the application of high quality or supercritical steam at a previously drilled and fracture stimulated well in tight oil resource formations.

FIG. 7 shows the application of supercritical steam injection system 700 for enhancing oil recovery from previously drilled and hydraulically fracture stimulated wells in tight oil resource formations utilizing the steam generator system 400. The wellbore 427 contains insulated coil tubing 705, a thermal packer 710, and a downhole steam choke nozzle 715. The supercritical steam pressure is higher than the pressure in the fracture system and the adjacent matrix material, which allows the propagation of the injectants and the expulsion of oil during a production cycle. Most unconventional wells, although they are intended to be horizontal inside the oil bearing formation, are drilled with a slight tilt upwards towards the toe of the well, to allow for proper liquid drainage. This design favors the propagation of injectants along the lateral leg.

Supercritical steam has heat losses which may be compensated by installing heating elements 720 in regular intervals. These elements 720 are heated by electricity, either by direct current, or by electromagnetic propagation. After the injection cycle is completed, the well is returned to production after a soak period, which allows for heat exchange to take place. This process enhances oil recovery by several means: by thermal expansion of the oil, reduction of viscosity, acceleration of diffusive flow into small fractures 725, by adding thermally induced fractures and by oil generation from kerogen imbedded in the rock material. Changes in formation temperature may also trigger mechanical slippage and reactivation of existing natural, or hydraulically induced fractures, thus enhancing the frequency and effectiveness of the fracture network to produce formation fluids and hydrocarbons. Excess oxygen reacts with light hydrocarbons effecting further heat release and in situ $CO_2$ generation which is a solvent that improves oil recovery. Excess $CO_2$ which is recovered is recycled back into the formation. Pressure letdown into two phase region is assumed. Residual oxidation (ROX) can be used. The horizontal length (lateral length) may be up to about 10,000 feet. Optionally, additional equipment may be added to the steam generator system 400 for recovery of $CO_2$ from the combustion process. The $CO_2$ can be co-injected with the supercritical steam via a separate flow path, which as one option may be flowed through the injector annulus.

Additionally, surface facilities for the steam injection system 700 may include a water purification unit an oxygen plant and a possibly a gas plant to separate produced $CO_2$, as described above in FIG. 3. Water injection rates may typically be less than 5,000 b/d per well. But drilling larger wellbores and using larger diameter tubulars could allow rates in the 10,000-15,000 b/d per well range. A first conduit (insulated coil tubing 705) extending into the reservoir 420 via the casing 455 or the downhole conduit 425 includes supercritical steam as described above in FIG. 4. A second conduit 730 extending into the reservoir 420 via the casing 455 or the downhole conduit 425 includes an oxygen and $CO_2$ mixture that is dispersed with the supercritical steam. The oxygen and $CO_2$ mixture may be pressurized.

In this particular embodiment, the maximum tail pressure is about 3,000 to about 6,000 psia with a reservoir pressure regime of about 2,000 to about 6,000 psia. A water injection rate may be less than about 5,000 b/d. A perforated interval may be about 5,000 feet, or greater. As one example, the calculated stoichiometric requirements include a fuel injection rate of about 1,419 MCF/d, a $CO_2$ generation rate of about 1,419 MCF/d, an oxygen injection rate of about 2,839 MCF/d, and about 384 b/d of combustion water.

Excess/additional fluids from the surface include about 2,000 MCF/d $CO_2$, about 142 MCF/d oxygen, and about 5% surplus oxygen in the tailpipe at the bottom of the downhole conduit 225. Thermal estimates include a heat injection rate of about 906 BTU/lb water, about 1,710 MMBTU/d, a heat injection rate of about 71.3 MMBTU/hr and a heat transfer of about 0.34 MMBTU/d/ft. Depressuring may be required. Input parameters include a depth gradient of about 0.45 psi/ft, a temperature gradient of about 1.2 degrees Fahrenheit/100 feet, and steam quality of about 0.9.

In another embodiment, supercritical steam from the steam generator system 400 delivers high temperature and pressure in a cyclic injection regime (e.g., 2-3 months) targeting deeper, virgin pressure reservoirs. Either a partial or completely supercritical steam reservoir process is envisioned. ROX can be used. This embodiment may be used to target high total organic carbon (TOC) unconventional reservoirs comprising shale at a depth of about 5,000 feet, or greater. Surplus oxygen in the ROX process provides $CO_2$ and generates heat in the formation.

In yet another embodiment, supercritical steam is provided downhole to the bottom hole injector via the insulated coil tubing 705, and the supercritical steam is maintained in the supercritical state. At the bottom, the downhole steam choke nozzle 715, functioning as a pressure letdown device, would be used to throttle pressure below the critical point to deliver two phase steam into the reservoir 420. This scheme can deliver somewhat higher volumes to the bottom of the injection well, since only a very hot, dense supercritical fluid would be flowing down the insulated coil tubing 705 (e.g., no gas aggravated pressure drop).

In some embodiments, the second conduit 730 would be utilized to deliver $CO_2$ and surplus $O_2$. The insulated coil tubing 705 would be highly insulated as it would be carrying very hot supercritical steam, such as about 800 degrees F. In an alternative embodiment, $CO_2$ and/or $O_2$ could be injected down the annulus of the insulated casing 455 to capture heat loss from the insulated coil tubing 705, hence allowing long term continuous injection. Any insulation only system would have some heat loss and would limit injection time to the point where the downhole conduit 425 heated up to 450 degrees Fahrenheit or so. Even for reservoirs at subcritical steam conditions, this scheme should be able to deliver 5,000+b/d of steam compared to 3,000-4,000 b/d of conventional systems.

In some embodiments, the injector diameter could be enlarged to accommodate 10,000+b/d injection rates. There would generally be no pressure letdown device to drop the steam to a partial pressure which would be below the P-H dome. Speculatively, this would mean somewhat higher bottom hole injection pressures. The reservoir could be managed to operate either entirely supercritical, or partially supercritical, depending on whether the producer well back pressure were held above or below critical. If above critical, a big detriment might be that the reservoir pressure would still be at supercritical steam pressure as well, hence preventing operation of a steam condensing front.

In other embodiments, which may be combined with one or more of the embodiments described above, $O_2$ could be added to the supercritical feed water at the surface, up to the saturation limit. This could preclude the use of a separate $CO_2/O_2$ injection line for projects requiring lower amounts of surplus $O_2$ for ROX purposes.

Figure 8:
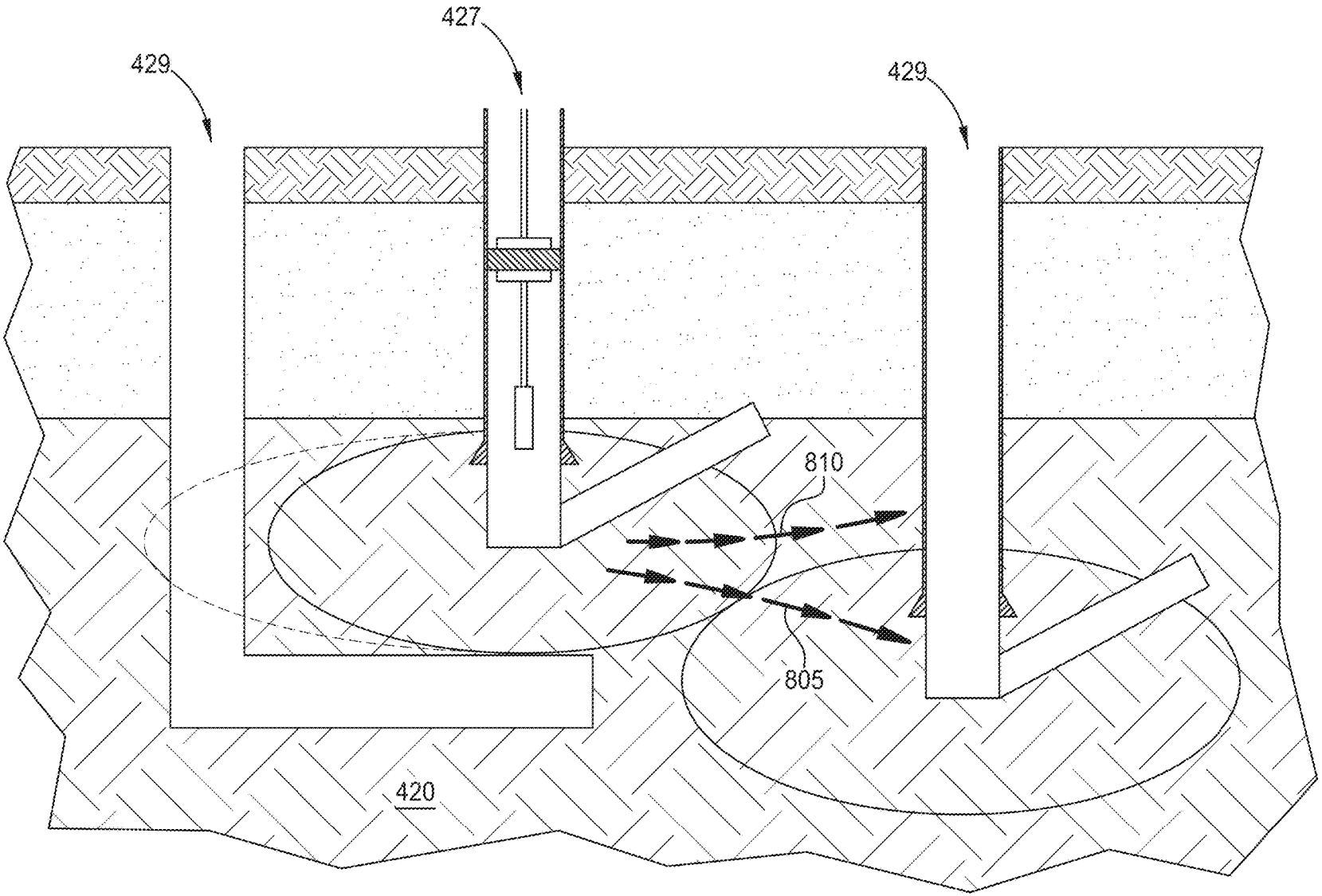
FIG. 8 is a diagram showing the application staggering of injection and production wells at different levels.

In a related embodiment shown in FIG. 8, a horizontal injection well 427 and a one or more production wells 429 can be combined to produce a continuous drive process. In an existing and mature field, a pressure depleted producer well could be turned into the injection well 427, while new infill wells would be the new producing wells 429. Vertically staggered well placement, if the formation thickness allows, would mitigate early injectant breakthrough. The liquid oil and water phases 805 would flow to the producing wells 429 and the light phases 810 of steam and $O_2$ would provide additional mobility control due to the staggering of wells. Injection and production wells can be placed in many different patterns and with varying ratios of injection wells to production wells. For example, producing wells could be located on the inside of a ring of injection wells or vice versa. Any combination of ratios and geometries of producer wells to injection wells is possible and may be used. For example, a line drive with alternating rows of injector wells and producer wells may also be used. Wells can be placed in regular or offset grids, with a plurality of injection wells to each production well. There could also be a plurality of production wells to each injection well.

The massive water injection volumes required for hydraulic fracturing present a host of challenges in causing underground interference with nearby wells, and in expensive lifting and disposal of the flow back water which may in some cases be related to unusual seismicity. When high pressure and temperature steam is applied in a short section of the wellbore at high rates, it can subject the formation to substantial stress, which in combination with steam expansion and thermal stresses will cause high complexity mechanical fracturing. The injection pressure and volume is expected to be lower than the ones used in hydraulic fracturing and this process can be applied to a small section of the wellbore, isolating and leveraging the stimulation process. In contrast, hydraulic fracturing follows a different mechanism, where fluids injected into the formation increasing the pore pressure and parting the formation with planar tensile fractures that need also to be filled with sand, or other fine particles called proppant to compensate the closure of those planes by the opposing formation stresses. In typical hydraulic fracturing, large sections (or stages) of the horizontal section of the well are treated simultaneously while perforated clusters are placed hoping for a diversion of fluids crating multiple planes. Developments in hydraulic fracturing practices are suggestive into making smaller stages and creating high intensity fractures which are not necessarily tensile, but also include shear and compressional mechanical failures along with activation of weak strength planes and natural fractures creating a high complexity diverse fracture system that is more effective in producing petroleum, while the necessity of proppants is reduced. Although the high fracture complexity stimulation process is desirable, it is difficult to be achieved by water injection and mechanical means alone.

Figure 9:
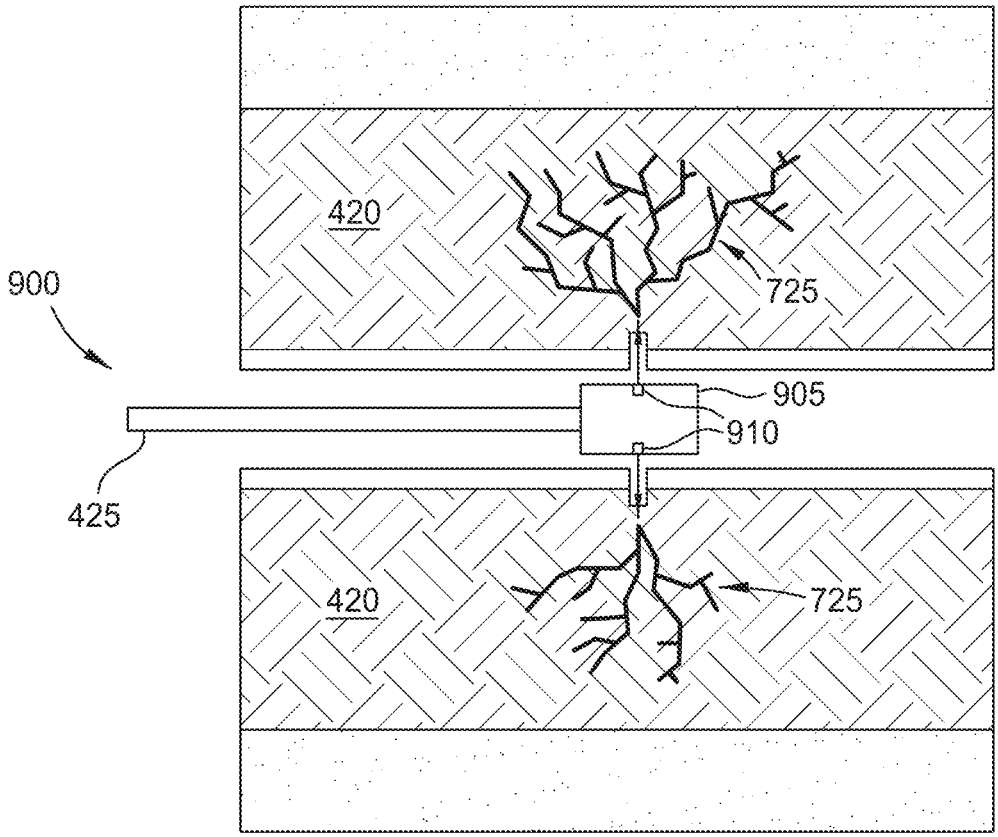
FIG. 9 is a diagram of a horizontal wellbore that is used to stimulate a formation with supercritical steam.

FIG. 9 shows the placement of a tail end apparatus 905 conveyed by coiled tubing or joined string 425 in a horizontal wellbore 900. The tail end apparatus 905 can stimulate the reservoir 420 by high pressure and temperature (supercritical) steam injection. The tail end apparatus 905 is placed first at the toe of the well and is slid towards the heel after successive treatments. The process requires successive cold water jetting followed by supercritical steam injection and cold back-circulation between successive treatments. In FIG. 9, the tail end apparatus 905 is positioned in the wellbore 900 and injection fluid is forced through nozzles 910 at high pressures. This treatment can be uses in intervals of several hundred feet and is applied in stages.

The operation of the stimulation apparatus is controlled by tubing injection of cold and superheated water and cold back circulation. The application of supercritical steam reduces the requirements of water, and it triggers mechanical and thermal fractures 725 which creates a complex, yet uniform stimulated area around the horizontal wellbore 900 and provides mechanisms to improve oil recovery by the introduction of heat and carbon dioxide.

There are advantages of thermal stimulation in terms of rock mechanics. The common method to hydraulically stimulate horizontal wells often results in planar and far extending tensile dominated hydraulic fractures. These artificially generated fractures require large quantities of proppant in order to remain open. The best results are achieved when the horizontal wells are specifically oriented parallel to the direction of the minimum horizontal stress. When this preferred well orientation is followed, it often results in less than optimal areal coverage as land development grid is mostly rectangular and favors either East-West or North-South well orientations. The presence of natural fractures influences the extent and effectiveness of hydraulic stimulation and may cause unwanted interference to nearby wells even at long distances. Under special circumstances, and when the stress distribution and the injection schedule are favorable, more complex fracturing is achieved when shearing occurs. Lateral rock movements cannot be reversed easily when the formation is relaxed to previous state and in this process proppant volume and placement schedule become less critical. Thermal stimulation introduces thermal stresses and shearing, making the stimulated area around the well more uniform and less influenced by well orientation and natural fracture variations.

Figure 10:
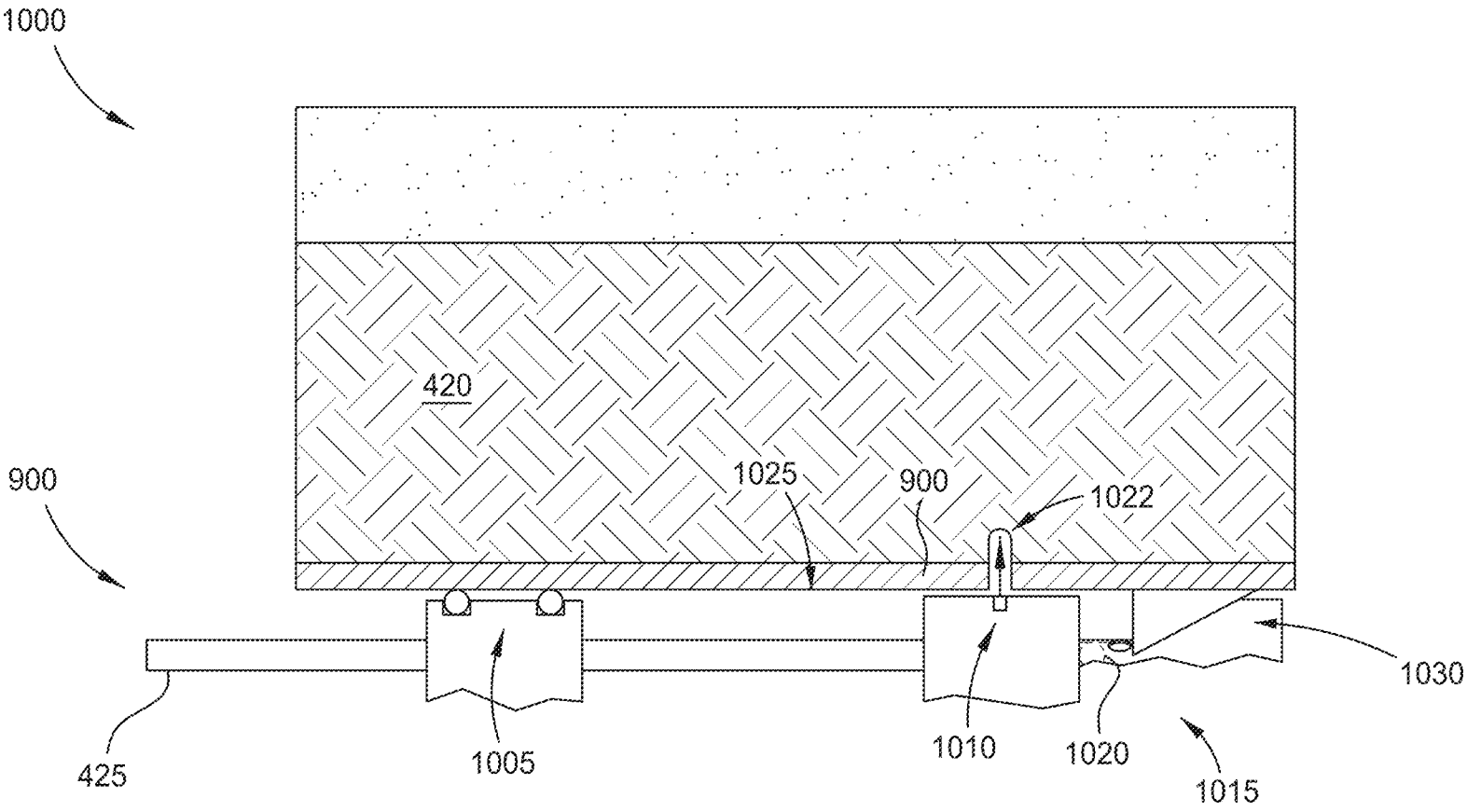
FIG. 10 is a diagram of the tail-end design used in thermal fracturing.

FIG. 10 shows one embodiment of a tail end assembly 1000 that is used as the tail end apparatus 905 of FIG. 9. The tail end assembly 1000 consists of three main parts which attach to the coil tubing 425. A thermal packer 1005, which is a packer assembly which can be set in coil tubing 425 to provide hydraulic insulation to the well annulus. Jet nozzles 1010, which provide initial perforation and later will act as chokes to high pressure and temperature steam as it is injected into the formation 420. And a tail end sealing assembly 1015 configured to isolate previously treated sections of a wellbore.

At the beginning of the operation, the thermal packer 1005 is set. A sealing ball 1020 is set and fluid is diverted through the jet nozzles 1010 to initiate a perforation 1022 through the wellbore wall 1025 and into the oil bearing formation. Gradually the temperature of the injected fluid is elevated to the supercritical steam supply level to initiate the mechanical-thermal stimulation process. At the end of this process the thermal packer 1005 is unset, and cold fluid is circulated back to the surface together with the sealing ball 1020. This allows a tail assembly expansion ring 1030 to cool and retract, allowing the assembly 1000 to be pulled to a new location by moving the coil tubing 425. Due to the lateral length of a horizontal portion of a well, one or more sections of the horizontal portion may be treated as opposed to processing the entire lateral length of the horizontal portion of the well. As different sections of the horizontal portion of the well are treated, the tail end sealing assembly 1015 is utilized to isolate the sections of the wellbore 900 that are already treated, then the operation as described above is repeated.

Figure 11:
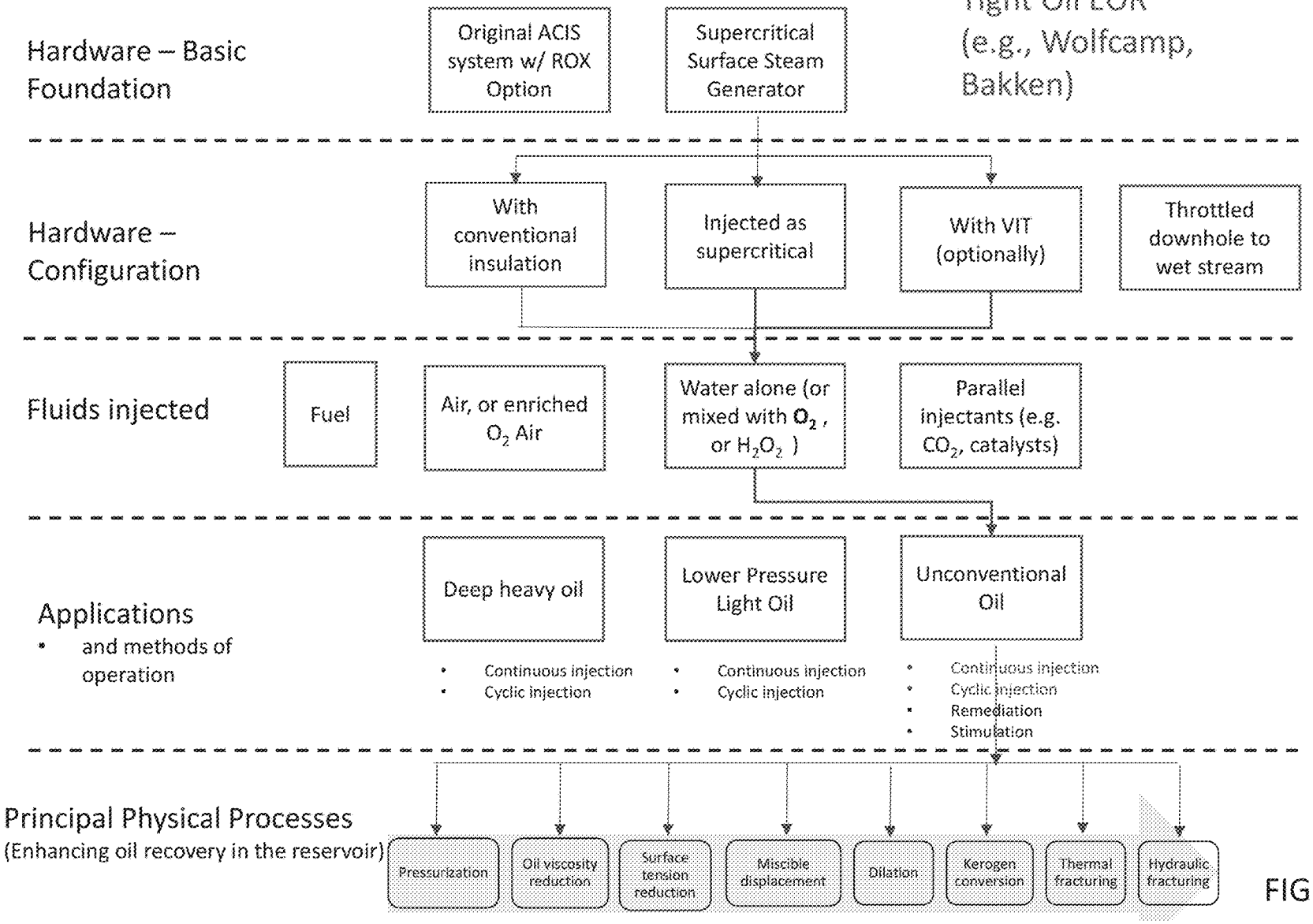
FIG. 11 illustrates a Super Critical Steam process diagram for tight oil enhanced recovery.

FIG. 11 illustrates a Super Critical Steam process diagram for tight oil enhanced recovery. In FIG. 11, which describes the main applicability of super critical steam, deep high pressure tight oil formations (including shale oil) can be exploited effectively either by continuous or periodic injection, or as a localized treatment. The thermal effects of slowly heating the formation would result in dilation of rock and fluids which is a very strong oil drive. In addition to that extra high temperatures will trigger a breakdown of long kerogen molecules into crude oil components, while extra high pressures would trigger or expand hydraulic fracturing. As the process scheme progresses, the more basic physical reservoir processes will also come into play.

Figure 12:
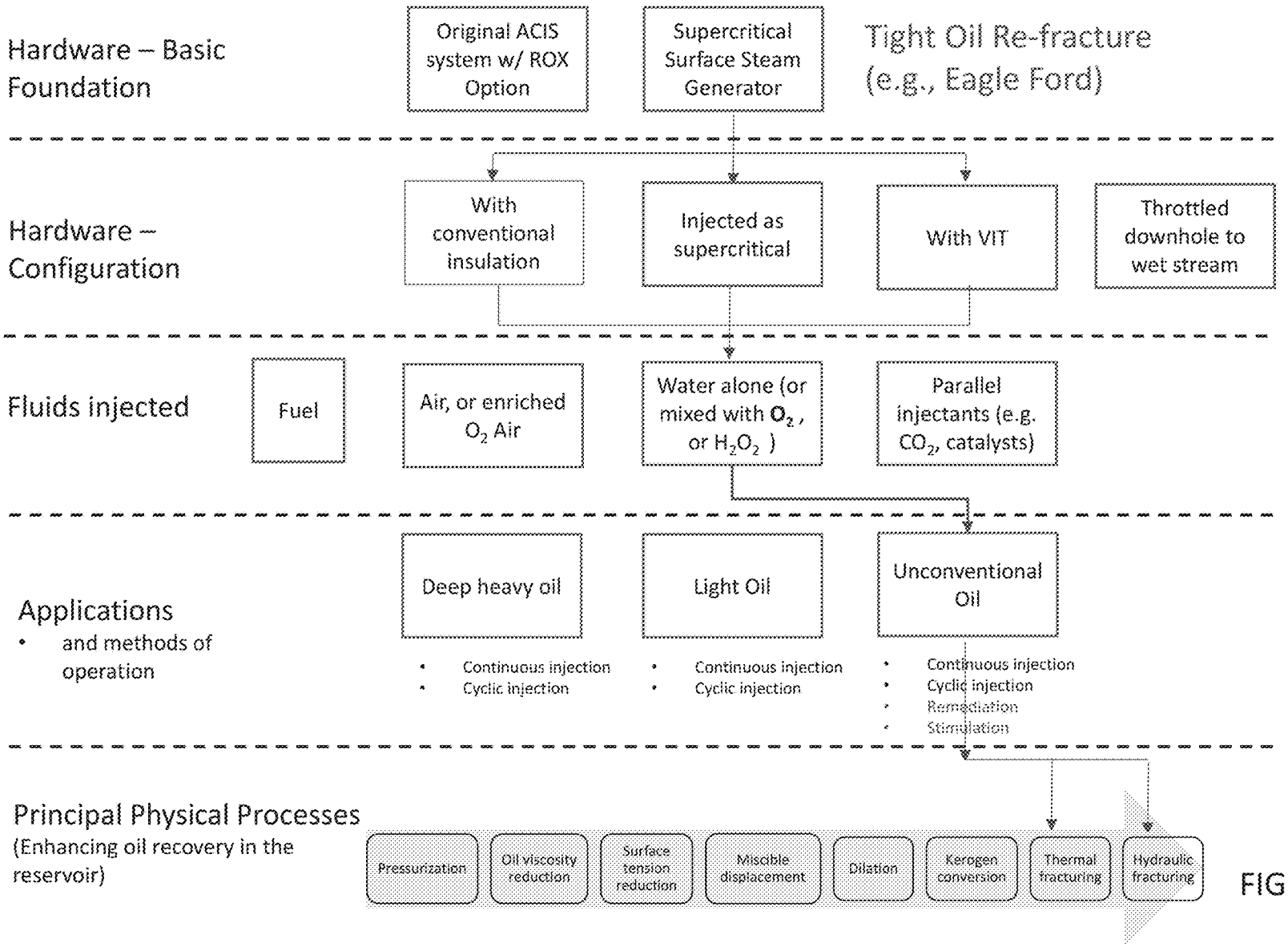
FIG. 12 illustrates a Super Critical Steam process diagram for tight oil enhanced recovery with stimulation.

FIG. 12 illustrates a Super Critical Steam process diagram for tight oil enhanced recovery with stimulation. In FIG. 12, the process is a high impact localized application of supercritical steam to a portion of the horizontal wellbore. This can be used in a new, or an existing oil producing well that needs re-stimulation. The localized treatments would produce "re-fracing" as the induced stresses together with the thermal shock would re-stimulate the formation by treating oil producing wells which have already gone through one primary production cycle.

Figure 13:
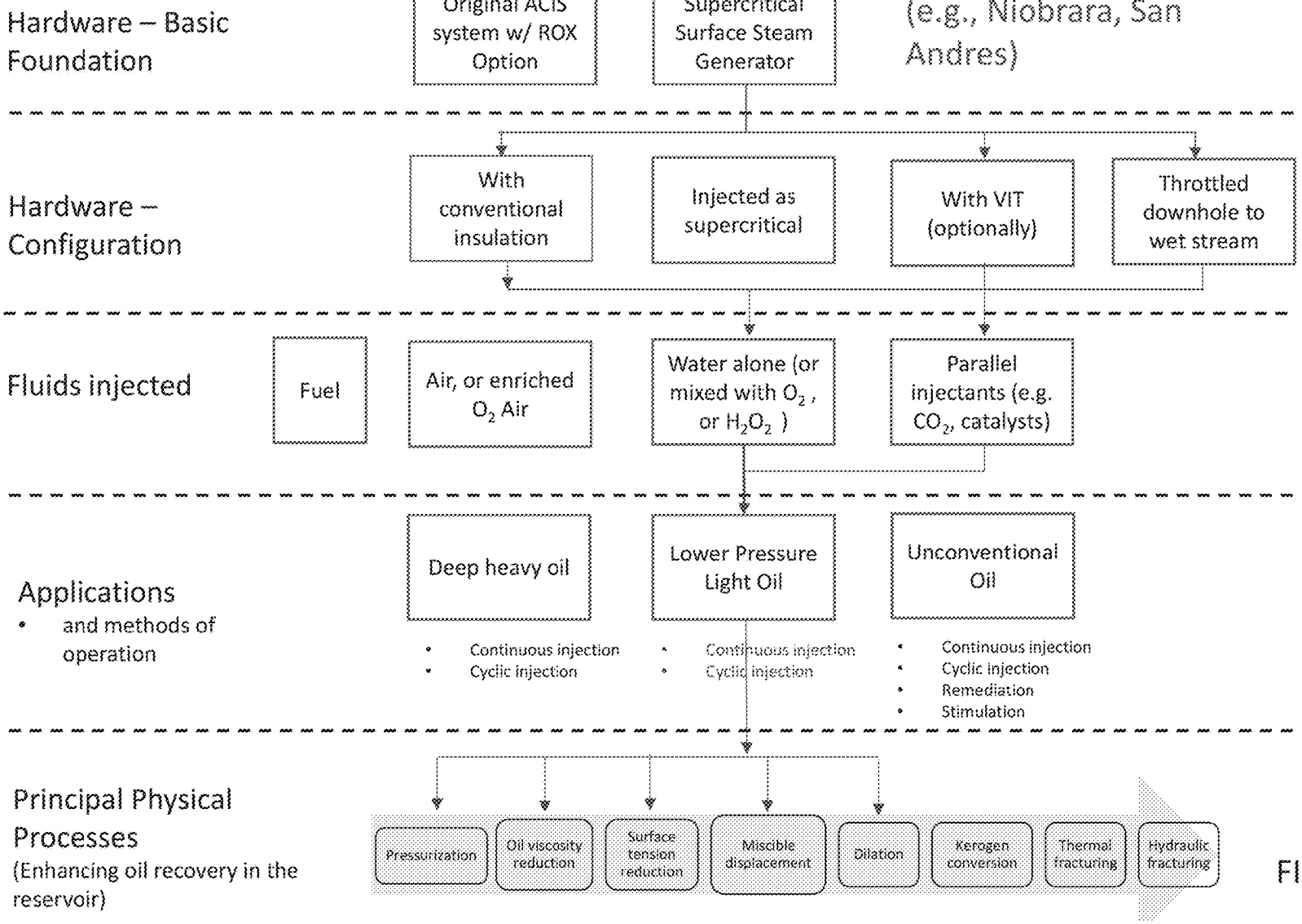
FIG. 13 illustrates a Super Critical Steam process diagram for shallow tight oil enhanced recovery.

FIG. 13 illustrates a Super Critical Steam process diagram for shallow tight oil enhanced recovery. In FIG. 13, for relatively low pressure tight oil formations, the supercritical steam would need to be throttled back close to reservoir pressure levels to avoid massive hydraulic fracturing, which may not be advantageous or necessary. During the throttling process, the high entropy super-critical steam would transition into high enthalpy high quality steam which would heat the formation, triggering heat related oil recovery processes. The process may be either cyclic or continuous. The process could be applied to recovery of heavy oil too deep to be reached by current DHSG technology.

In one embodiment, a method for producing hydrocarbons from a reservoir comprises supplying a fuel and an oxidant to a combustion heater; supplying pressurized water to a heat exchanger within the combustion heater; heating the pressurized water to form steam; flowing the steam through a first conduit into the reservoir, wherein the steam may be supercritical; varying injection of the steam into the reservoir using a throttle in or on the first conduit; and recovering hydrocarbons from the reservoir.

In one embodiment, a steam injection system comprises a wellhead; a supercritical steam generator fluidly coupled to the wellhead; and insulated casing extending into a reservoir.

In one embodiment, a steam injection system comprises a wellhead; a casing extending from the wellhead into a reservoir; a downhole steam generator positioned in the casing, wherein the downhole steam generator is suspended below an umbilical that supplies water and fuel in separate conduits to the downhole steam generator; a packer positioned below the downhole steam generator; a packer fluid contained between the packer and the wellhead; a tailpipe apparatus coupled to the downhole steam generator to inject steam into the reservoir; and a tail end sealing assembly to isolate a portion of the well that thermally stimulates the reservoir.

While the foregoing is directed to several embodiments, other and further embodiments may be devised without departing from the basic scope thereof, and the scope thereof is determined by the claims that follow.

The invention claimed is:

1. A method for producing hydrocarbons from a reservoir, comprising:

positioning a surface mounted combustion heater adjacent to a first well;

supplying a fuel and an oxidant to the combustion heater;

supplying pressurized water to a heat exchanger within the combustion heater;

heating the pressurized water to form a supercritical steam;

flowing the supercritical steam through a first conduit into the reservoir;

thermally stimulating the reservoir; and recovering hydrocarbons from the reservoir.

2. The method of claim 1, wherein surplus oxygen is flowed through the first conduit into the reservoir.

3. The method of claim 1, wherein oxygen is flowed into the first well in an annulus of an insulated conduit extending into the reservoir.

4. The method of claim 1, wherein excess carbon dioxide is flowed through the first conduit into the reservoir.

5. The method of claim 1, wherein carbon dioxide is flowed into the first well in an annulus of an insulated conduit extending into the reservoir.

6. The method of claim 1, wherein the pressurized water is flowed into the heat exchanger at a pressure of about 6,000 psia.

7. The method of claim 1, wherein hydrocarbons are produced from the first well.

8. The method of claim 1, wherein hydrocarbons are produced from a second well spaced from the first well.

9. The method of claim 1, wherein the pressure is reduced in the wellbore using a throttle.

10. The method of claim 9, wherein the throttle can be a simple orifice.

11. The method of claim 1, wherein the pressure is not reduced in the wellbore and the fluid remains a supercritical fluid as it enters the formation.

12. The method of claim 1, wherein there is a high enough back pressure maintained in the formation to keep the fluid supercritical throughout the formation.

13. The method of claim 1, where the reservoir is mechanically and thermally stimulated uniformly.

14. A method for producing hydrocarbons from a reservoir, comprising:

supplying a fuel and an oxidant to a combustion heater;

supplying pressurized water to a heat exchanger within the combustion heater;

heating the pressurized water to form steam in a supercritical state;

flowing the steam through a first conduit for injection into the reservoir, wherein the steam is in the supercritical state when injected into the reservoir;

thermally stimulating the reservoir using the steam; and recovering hydrocarbons from the reservoir.

15. The method of claim 14, wherein the combustion heater is surface mounted.

16. The method of claim 15, wherein surplus oxidizers are injected into the reservoir along with the steam.

17. The method of claim 15, wherein one or a combination of carbon dioxide, a catalyst, and hydrogen peroxide is injected into the reservoir.

18. The method of claim 14, wherein the combustion heater is a downhole steam generator.

19. The method of claim 18, wherein surplus oxidizers are injected into the reservoir along with the steam.

20. The method of claim 18, wherein one or a combination of carbon dioxide, a catalyst, and hydrogen peroxide is injected into the reservoir.

* * * * *